US008324314B2

(12) United States Patent
Brown et al.

(10) Patent No.: US 8,324,314 B2
(45) Date of Patent: Dec. 4, 2012

(54) FLUOROPOLYMER COMPOSITIONS AND TREATED SUBSTRATES

(75) Inventors: Gerald Oronde Brown, Wilmington, DE (US); Michael Henry Ober, Wilmington, DE (US)

(73) Assignee: E.I. du Pont de Nemours and Company, Wilmington, DE (US)

( * ) Notice: Subject to any disclaimer, the term of this patent is extended or adjusted under 35 U.S.C. 154(b) by 518 days.

(21) Appl. No.: 12/577,334

(22) Filed: Oct. 12, 2009

(65) Prior Publication Data

US 2011/0084227 A1 Apr. 14, 2011

(51) Int. Cl.

| | |
|---|---|
| ***A63B 37/00*** | (2006.01) |
| ***B01F 17/00*** | (2006.01) |
| ***B05D 3/02*** | (2006.01) |
| ***B32B 5/08*** | (2006.01) |
| ***B32B 5/12*** | (2006.01) |
| ***B32B 5/26*** | (2006.01) |
| ***B32B 25/02*** | (2006.01) |
| ***B32B 25/10*** | (2006.01) |
| ***B32B 27/00*** | (2006.01) |
| ***B32B 27/04*** | (2006.01) |
| ***B32B 27/12*** | (2006.01) |
| ***B32B 27/40*** | (2006.01) |
| ***C08G 18/08*** | (2006.01) |
| ***C08G 18/28*** | (2006.01) |
| ***C08J 3/00*** | (2006.01) |
| ***C08K 3/10*** | (2006.01) |
| ***C08K 3/18*** | (2006.01) |
| ***C08K 3/20*** | (2006.01) |
| ***C08K 3/22*** | (2006.01) |
| ***C08L 75/00*** | (2006.01) |
| ***D03D 15/00*** | (2006.01) |
| ***D03D 25/00*** | (2006.01) |

(52) U.S. Cl. ..... 524/590; 427/372.2; 427/385.5; 428/423.1; 442/58; 442/79; 442/80; 442/81; 442/83; 442/85; 442/86; 442/89; 442/92; 442/93; 442/94; 442/106; 442/115; 442/124; 442/131; 442/181; 442/218; 442/275; 442/280; 442/281

(58) Field of Classification Search ..... 427/372.2, 427/385.5; 428/423.1; 524/589, 590, 591, 524/839, 840, 413, 430, 431, 432; 442/58, 442/79, 80, 83, 85, 86, 89, 92, 93, 94, 106, 442/115, 124, 131, 181, 218, 275, 280, 281
See application file for complete search history.

(56) References Cited

U.S. PATENT DOCUMENTS

| | | | | |
|---|---|---|---|---|
| 5,414,111 | A | 5/1995 | Kirchner | |
| 5,481,028 | A | 1/1996 | Petrov et al. | |
| 6,632,531 | B2 * | 10/2003 | Blankenship | 428/402 |
| 2005/0095933 | A1 | 5/2005 | Kimbrell et al. | |
| 2008/0015298 | A1 | 1/2008 | Xiong et al. | |
| 2009/0148654 | A1 * | 6/2009 | Brown et al. | 428/96 |

FOREIGN PATENT DOCUMENTS

| | | |
|---|---|---|
| CN | 101434802 | 5/2009 |
| EP | 825241 | 3/2003 |
| JE | 2000264948 | 9/2000 |
| JP | 1996269367 | 10/1996 |
| JP | 1998033321 | 2/1998 |
| JP | 2007099726 | 4/2007 |
| JP | 2009235151 | 10/2009 |
| JP | 2009256598 | 11/2009 |
| WO | 95/11877 | 5/1995 |
| WO | 9728303 | 8/1997 |
| WO | 9924523 | 5/1999 |
| WO | 0047666 | 8/2000 |
| WO | WO 2005/080465 A1 | 9/2005 |
| WO | WO 2009/076108 A1 | 6/2009 |
| WO | WO 2009/076179 A2 | 6/2009 |

OTHER PUBLICATIONS

Honda, et al., Molecular Aggregation Structure and Surface Properties of Poly(fluoroalkyl acrylate) Thin Films, American Chemical Society, 2005, 38, 5599-5705.

Naud, C., et al., Synthesis of terminally perfluorinated long-chain alkanethiols, sulfides and disulfides from the corresponding halides, Journal of Fluorine Chemistry 104 (2000) 173-183.

(Continued)

*Primary Examiner* — Patrick Niland
(74) *Attorney, Agent, or Firm* — Erik W. Perez

(57) ABSTRACT

A composition for imparting surface properties to substrates comprising a polymer of at least one polyurethane having at least one urea linkage prepared by:

(i) reacting (a) at least one diisocyanate, polyisocyanate, or mixture thereof, having isocyanate groups, and (b) at least one fluorinated compound selected from the formula (I):

$$R_f^1\text{-L-X} \qquad \text{(I)}$$

wherein $R_f^1$ is a monovalent, partially or fully fluorinated, linear or branched, alkyl radical having 2 to 100 carbon atoms; optionally interrupted by 1 to 50 oxygen atoms; wherein the ratio of carbon atoms to oxygen atoms is at least 2:1 and no oxygen atoms are bonded to each other;

L is a bond or a linear or branched divalent linking group having 1 to about 20 carbon atoms, said linking group optionally interrupted by 1 to about 4 hetero-radicals selected from the group consisting of —O—, —$NR^1$—, —S—, —SO—, —$SO_2$—, and —$N(R^1)C(O)$— wherein $R^1$ is H or $C_1$ to $C_6$ alkyl, and said linking group optionally substituted with $CH_2Cl$;

X is an isocyanate-reactive group selected from the group consisting of —OH, —N(R)H, and —SH; and thereafter (ii) reacting with (c) water and (d) 0.05 to about 2.0% by weight of an isocyanate-reactive fluorinated particulate component, based on a total dry weight of the composition.

20 Claims, No Drawings

OTHER PUBLICATIONS

Rondestvedt et al, Nucleophilic Displacements on β-(perfluoroalkyl)ethyl Iodides. Synthesis of Acrylates Containing Heteroatoms, Journal of Organic Chemistry (1977), 42(16), 2680-2683.

Trabelsi et al., Synthese des 2-F-alkylethylamines: optimization de l'obtention des azortures de 2-F-alkyethyle et de leur reduction en amines; Journal of Fluorine Chemistry (1994), 69, 115-117. Abstract.

* cited by examiner

FLUOROPOLYMER COMPOSITIONS AND TREATED SUBSTRATES

FIELD OF THE INVENTION

The present invention relates to the use of particle-modified fluoropolymers to provide oil repellency, water repellency, and soil resistance to substrates, wherein the particles are fluorinated.

BACKGROUND OF THE INVENTION

Various fluorinated polymer compositions are known to be useful as treating agents to provide surface effects to substrates. Surface effects include repellency, soil resistance, soil release, stain resistance and stain release, and other effects, which are particularly useful for fibrous substrates and other substrates such as hard surfaces. Many such treating agents are fluorinated polymers or copolymers.

Most commercially available fluorinated polymers useful as treating agents for imparting repellency to substrates contain predominantly more than eight carbons in the perfluoroalkyl chain to provide the desired properties. Honda et al, in Macromolecules (2005), 38(13), 5699-5705, teach that for perfluoroalkyl chains of greater than 8 carbons, orientation of the perfluoroalkyl chains is maintained in a parallel configuration while for such fluoroalkyl chains having fewer carbons, reorientation occurs. Thus short fluoroalkyl groups having 6 or less carbons have traditionally not been successful commercially for imparting surface effects to substrates because of the absence of highly ordered perfluoroalkyl chains at the outermost surfaces.

U.S. Patent Application 2005/0095933 discloses compositions for treating textiles formed by combining a repellent component, a stain resist component, a stain release component, and particles. Various commercially available fluorinated polymers are employed as the repellent component and the particles are inorganic oxides or basic metal salts. The fluorinated polymers and particles are separately added to a solution, and thus represent a mixture of the polymer and particle, which is applied to the substrate to be treated.

The expense of the fluorinated polymer dictates that it be used at lower levels in treating substrates to provide surface effects. However, reducing the level of fluorine by using polymers containing shorter chained perfluoroalkyl groups of six carbons or less has not been commercially successful. Thus there is a need for compositions for treating substrates which impart surface effects including water repellency, oil repellency, and soil resistance, which maintain levels of performance, while using less of the expensive fluorinated component. The present invention provides such a composition.

SUMMARY OF INVENTION

The present invention comprises a composition for imparting surface properties to substrates comprising an aqueous solution or dispersion of a polymer of at least one polyurethane having at least one urea linkage prepared by:

(i) reacting (a) at least one diisocyanate, polyisocyanate, or mixture thereof, having isocyanate groups, and (b) at least one fluorinated compound selected from the formula (I):

$$R_f^1\text{-L-X} \qquad \text{(I)}$$

wherein $R_f^1$ is a monovalent, partially or fully fluorinated, linear or branched, alkyl radical having 2 to about 100 carbon atoms; optionally interrupted by 1 to about 50 oxygen atoms; wherein the ratio of carbon atoms to oxygen atoms is at least 2:1 and no oxygen atoms are bonded to each other;

L is a bond or a linear or branched divalent linking group having 1 to about 20 carbon atoms, said linking group optionally interrupted by 1 to about 4 hetero-radicals selected from the group consisting of —O—, —$NR^1$—, —S—, —SO—, —$SO_2$—, and —$N(R^1)C(O)$— wherein $R^1$ is H or $C_1$ to $C_6$ alkyl, and said linking group optionally substituted with $CH_2Cl$;

X is an isocyanate-reactive group selected from the group consisting of —OH, —$N(R^1)H$, and —SH wherein $R^1$ is as defined above; and thereafter (ii) reacting with (c) water and (d) 0.05 to about 2.0% by weight of an isocyanate-reactive fluorinated particulate component, based on total dry weight of the composition.

The present invention further comprises a method of providing water repellency, oil repellency and soil resistance to substrates comprising contacting said substrate with a composition of the present invention as described above.

The present invention further comprises a substrate which has been contacted with a composition of the present invention as described above.

DETAILED DESCRIPTION OF INVENTION

Hereinafter trademarks are designated by upper case.

The present invention provides compositions for imparting surface effects to substrates in which fluorinated polymers have fluorinated particles incorporated during the polymerization reaction used to form the polymers. Thus the particles are part of the polymer chemical structure. The fluorinated particles have reactive functionalities on their surfaces, and are reacted during polymerization in the synthesis of either solution based or emulsion based fluorinated polymers. The resulting composition provides enhanced performance and durability of surface effects to treated substrates compared to traditional commercially available treatment agents not containing particles, or compared to compositions wherein treatment agents are physically mixed with particles in a treatment bath prior to application. It has been found that incorporation of small amounts as low as 0.1% by weight of a fluorinated particle into the polymer structure is effective to enhance performance. Preferably from about 0.1% to about 5% by weight, more preferably from about 0.1% to about 3% by weight, and more preferably from about 0.1% to about 1% by weight, of the particle component is incorporated into the polymer. This invention permits use of lower amounts of traditional treatment agents, or use of agents containing short perfluoroalkyl chains of less than 8 carbon atoms (and thus containing less fluorine) without any decrease in performance.

The compositions of the present invention are prepared by first reacting (a) at least one diisocyanate, polyisocyanate, or mixture thereof, having isocyanate groups, and (b) at least one fluorinated compound. This is then reacted with (c) water and (d) an isocyanate-reactive fluorinated particulate component. The resulting polymer is the composition of the present invention as defined above.

Fluorinated compounds of formula (I) are useful as component (b) in preparation of various compositions of the invention.

$$R_f^1\text{-L-X} \qquad \text{(I)}$$

$R_f^1$ is a monovalent, partially or fully fluorinated, linear or branched, alkyl radical having 2 to about 100 carbon atoms;

optionally interrupted by 1 to about 50 oxygen atoms; wherein the ratio of carbon atoms to oxygen atoms is at least 2:1, and preferably from about 2:1 to about 3:1; and no oxygen atoms are bonded to each other. Any one carbon atom within $R_f^1$ can have up to two single bonds to oxygen. L is a bond or a linear or branched divalent linking group having 1 to about 20 carbon atoms, said linking group optionally interrupted by 1 to about 4 hetero-radicals selected from the group consisting of —O—, —$NR^1$—, —S—, —SO—, —$SO_2$—, and —$N(R^1)C(O)$— wherein $R^1$ is H or $C_1$ to $C_6$ alkyl, and said linking group optionally substituted with $CH_2Cl$;

Preferred $R_f^1$ groups include $F(CF_2)_n$, $F(CF_2)_n(CH_2)_x[(CF_2CF_2)_p(CH_2CH_2)_q]_m$, $F(CF_2)_nO(CF_2)_n$, $F(CF_2)_nOCFHCF_2$, or $F(CF_2)_n[OCF_2CF(CF_3)]_p[OCF_2CF_2]_q$, wherein n is 1 to about 6; x is 1 to about 6; and p, q, and m are each independently 1 to about 3.

Preferably L is a bond or a linking group $-(L^1)_p-$; wherein p is an integer of 1 to 4, and $L^1$ is selected from the group consisting of —$(C_tH_{2t})$— wherein t is an integer of 1 to 10; phenylene; $C_1$-$C_4$ alkyl substituted phenylene; ethylene oxide; $R^5$; or $R^5$-A wherein A is a divalent $C_1$ to $C_6$ alkyl, and $R^5$ is a divalent radical selected from the group consisting of —$S(CH_2)_u$—,

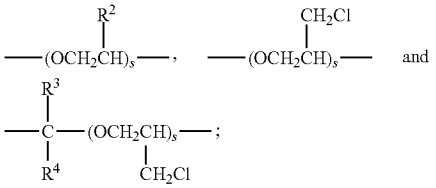

u is an integer of from about 2 to about 4;

s is an integer of 1 to about 50; and $R^2$, $R^3$, and $R^4$ are each independently hydrogen or an alkyl group containing 1 to about 6 carbon atoms. More preferably L is a bond; —$(C_tH_{2t})$—$(R^5)_r$— wherein t is an integer of 1 to 10 and r is 0 or 1; —$(R^5)_r$— wherein r is 0 or 1; or $(OCH_2CH_2)_v$ wherein v is 2 to 4.

One embodiment of the present invention are compositions prepared using fluorinated compounds of formula (I), $R_f^1$-L-X, which are selected from the group consisting of formulas (Ia), (Ib), (Ic), and (Id):

$$F(CF_2)_n(CH_2)_t—X \quad \text{(Ia)}$$

$$F(CF_2)_n(CH_2)_x[(CF_2CF_2)_p(CH_2CH_2)_q]_m(R^5)_rX \quad \text{(Ib)}$$

$$F(CF_2)_nO(CF_2)_nCH_2(C_tH_{2t})(R^5)_rX \quad \text{(Ic)}$$

$$F(CF_2)_nOCFHCF_2(CH_2CH_2)_vX \quad \text{(Id)}$$

wherein t is an integer of 1 to 10;

n is an integer of 2 to 6;

m is an integer 1 to 3;

p and q are each independently an integer of 1 to 3;

v is an integer of 2 to 4;

r is 0 or 1;

X is —OH, —$N(R^1)H$ or —SH;

$R^5$ is a divalent radical selected from the group consisting of —$S(CH_2)_u$—,

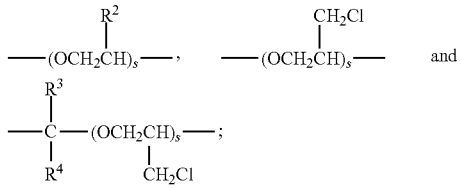

u is an integer of 2 to 4;

s is an integer of 1 to 50;

$R^1$, $R^2$, $R^3$, and $R^4$ are each independently hydrogen or an alkyl group containing 1 to 6 carbon atoms.

Fluorinated compounds of formula (Ia) useful in the preparation of compositions of the present invention are available from E. I. du Pont de Nemours and Company, Wilmington, Del. 19898 USA. A mixture can be used; for instance, a perfluoroalkylethyl alcohol mixture of the formula $F(CF_2)_hCH_2CH_2OH$, wherein h ranges from 6 to about 14, and is predominately 6, 8, and 10; or a purified fraction can be used, for instance, 1H,1H,2H,2H-perfluorohexanol. One preferred embodiment is a composition of the invention wherein $R_f^1$-L-X is formula (1a), wherein X is OH, and n is an integer 2 to 4.

Fluorinated compounds of formula (Ib) useful in the preparation of various embodiments of the invention are prepared by synthesis of perfluoroalkyl iodides with ethylene. The fluoroalkyl iodides useful as telogen reactants for the preparation of the compounds of formula (Ib) of the present invention include $(F(CF_2)_n(CH_2)_2I$, $F(CF_2)_n(CH_2)I$ or $F(CF_2)_nI)$, wherein n is an integer from 1 to about 6. Preferably n is from about 2 to about 4; more preferably n is 2. The most preferable fluoroalkyl iodide reactant is perfluoroethylethyl iodide.

The iodides of formula (Ib) of the present invention, $F(CF_2)_n(CH_2)_x[(CF_2CF_2)_p(CH_2CH_2)_q]_mI$, wherein n, x, p, q, and m are as defined above, are preferably prepared by oligomerization of $(F(CF_2)_n(CH_2)_2I$, $F(CF_2)_n(CH_2)I$ or $F(CF_2)_nI)$ using a mixture of ethylene (ET) and tetrafluoroethylene (TFE). The reaction can be conducted at any temperature from room temperature to about 150° C. with a suitable radical initiator. Preferably the reaction is conducted at a temperature of from about 40° C. to about 100° C. with an initiator which has about a 10 hour half-life in that range. The feed ratio of the starting materials in the gas phase, that is the moles of $(F(CF_2)_n(CH_2)_2I$, $F(CF_2)_n(CH_2)I$ or $F(CF_2)_nI)$ verse the combined moles of ethylene and tetrafluoroethylene, can be used to control conversion of the reaction. This mole ratio is from about 1:3 to about 20:1, preferably from about 1:2 to 10:1, more preferably from about 1:2 to about 5:1 The mole ratio of ethylene to tetrafluoroethylene is from about 1:10 to about 10:1, preferably from about 3:7 to about 7:3, and more preferably from about 4:6 to about 6:4.

The alcohols of formula (Ib) of the present invention $F(CF_2)_n(CH_2)_x[(CF_2CF_2)_p(CH_2CH_2)_q]_mOH$, wherein n, x, p, q, and m are as described above, are prepared from the oligomeric iodides $F(CF_2)_n(CH_2)_2I$, $F(CF_2)_n(CH_2)I$ or $F(CF_2)_nI$ using an oleum treatment and hydrolysis. It has been found, for example, that reacting with oleum (15% $SO_3$) at about 60° C. for about 1.5 hours, followed by hydrolysis using an iced dilute $K_2SO_3$ solution, and then followed by heating to about 100° C. for about 30 minutes gives satisfactory results. But other reaction conditions can also be used. After being cooled to ambient room temperature, a solid is precipitated, isolated and purified. For example, the liquid is then decanted and the solid is dissolved in ether and washed with water saturated with NaCl, dried over anhydrous $Na_2SO_4$, and concentrated and dried under vacuum. Other conventional purification procedures can be employed.

Alternatively, the alcohols of formula (Ib) of the present invention can be prepared by heating the above oligomeric iodides ($F(CF_2)_n(CH_2)_2I$, $F(CF_2)_n(CH_2)I$ or $F(CF_2)_nI$ with N-methylformamide to about 150° C. and holding for about 19 hours. The reaction mixture is washed with water to give a residue. A mixture of this residue with ethanol and concentrated hydrochloric acid is gently refluxed (at about 85° C. bath temperature) for about 2.5 hours. The reaction mixture is washed with water, diluted with dichloromethane, and dried over sodium sulfate. The dichloromethane solution is concentrated and distilled at reduced pressure to give the alcohol. Optionally N,N dimethylformamide can be used instead of N-methylformamide. Other conventional purification procedures can also be employed.

Amines of formula (Ib) can be prepared by first preparing amides from the corresponding iodides, ($F(CF_2)_n(CH_2)_2I$, $F(CF_2)_n(CH_2)I$ or $F(CF_2)_nI$. The azides having formula $F(CF_2)_n(CH_2)_x[(CF_2CF_2)_p(CH_2CH_2)_q]_mN_3$, wherein n, x, p, q, and m are as described above, are prepared from the oligomeric iodides using sodium azide as per a modified procedure disclosed in the literature (Rondestvedt, C. S., Jr.; Thayer, G. L., Jr. J. Org. Chem. 1977, 42, 2680). Displacement of iodide to azide is performed in quantitative yields in a mixed solvent system comprising acetonitrile and water in a ratio of about 3:1 using sodium azide at 90° C. Alternatively a solvent system comprising dimethylformamide-water, acetone-water, isopropyl alcohol-water or other similar solvent system can be used for this reaction under similar conditions. A phase transfer reaction as described by Carnbon et. al. can be used for this conversion, which produces only moderate yield (20-30%) of the azide after 36 h at 100° C. (Trabelsi, H.; Szoenyi, F.; Michelangeli, N.; Carnbon, A. J. Fluorine Chem., 1994, 69, 115-117).

The amines of formula (Ib) of the present invention $F(CF_2)_n(CH_2)_x[(CF_2CF_2)_p(CH_2CH_2)_q]_mNH_2$, wherein n, x, p, q, and m are as described above, are prepared from the above oligomeric azides by reduction using hydrazine hydrate and Ni-Raney as per a modified literature procedure (Trabelsi, H.; Szoenyi, F.; Michelangeli, N.; Carnbon, A. J. Fluorine Chem., 1994, 69, 115-117). Transformation of oligomer azide to amine is performed in a mixed solvent system comprising 1:1 water and ethanol using hydrazine hydrate/Ni-Raney at 60° for 12 h. and sodium azide. Alternatively, catalytic hydrogenation using Pt/C or various conditions involving other reducing agents also can be used to effect this transformation.

The thiols of formula (Ib) of the present invention $F(CF_2)_n(CH_2)_x[(CF_2CF_2)_p(CH_2CH_2)_q]_mSH$, wherein n, x, p, q, and m are as described above, are prepared from the oligomeric iodides ($F(CF_2)_n(CH_2)_2I$, $F(CF_2)_n(CH_2)I$ or $F(CF_2)_nI$ by the reaction with thiourea followed by hydrolysis of the thiouronium salt as per the literature procedure (Rondestvedt, C. S., Jr.; Thayer, G. L., Jr. J. Org. Chem. 1977, 42, 2680). The oligomeric iodides were refluxed with thiourea in ethanol for 36 h and hydrolyzed using sodium hydroxide to obtain the corresponding oligomeric thiols. Alternatively, displacement reaction using NaSH in ethanol can be used to effect this transformation.

The sulfur-containing alcohols of formula (Ib) of the present invention $F(CF_2)_n(CH_2)_x[(CF_2CF_2)_p(CH_2CH_2)_q]_mS(CH_2)_uOH$, wherein n, x, p, q, and m are as described above u is an integer of about 2 to 4, are prepared from the oligomeric iodides ($F(CF_2)_n(CH_2)_2I$, $F(CF_2)_n(CH_2)I$ or $F(CF_2)_nI$ by the displacement reaction with 2-mercaptoethanol as per the literature procedure (Rondestvedt, C. S., Jr.; Thayer, G. L., Jr. J. Org. Chem. 1977, 42, 2680). The oligomeric iodides were refluxed with 2-mercaptoethanol and sodium hydroxide in tert-butanol for 12 h to obtain the corresponding oligomeric hydroxyethyl sulfide.

The sulfur-containing amines of formula (Ib) of the present invention $F(CF_2)_n(CH_2)_x[(CF_2CF_2)_p(CH_2CH_2)_q]_mS(CH_2)_uNH_2$, wherein n, x, p, q, and m are as described above u is an integer of about 2 to 4, are prepared from the oligomeric iodides $F(CF_2)_n(CH_2)_2I$, $F(CF_2)_n(CH_2)I$ or $F(CF_2)_nI$ by the displacement reaction with 2-aminoethanethiol as per the literature procedure. (Rondestvedt, C. S., Jr.; Thayer, G. L., Jr. J. Org. Chem. 1977, 42, 2680). The oligomeric iodides were refluxed with 2-mercaptoethylamine hydrochloride and sodium hydroxide in tert-butanol for 12 h to obtain the corresponding oligomeric aminoethyl sulfide.

The fluoroalcohols of formula (Ic), wherein X is OH, used to make the compositions of the present invention are available by the following series of reactions wherein $R_f^3$ is $F(CF_2)_n$, n is 2 to 6, and q is 1 to 6:

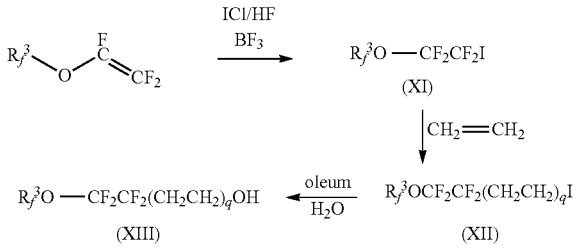

The starting perfluoroalkyl ether iodides are made by the procedure described in U.S. Pat. No. 5,481,028, herein incorporated by reference, in Example 8, which discloses the preparation of compounds of formula (XI) from perfluoro-n-propyl vinyl ether.

In the second reaction above, a perfluoroalkyl ether iodide (XI) is reacted with an excess of ethylene at an elevated temperature and pressure. While the addition of ethylene can be carried out thermally, the use of a suitable catalyst is preferred. Preferably the catalyst is a peroxide catalyst such as benzoyl peroxide, isobutyryl peroxide, propionyl peroxide, or acetyl peroxide. More preferably the peroxide catalyst is benzoyl peroxide. The temperature of the reaction is not limited, but a temperature in the range of 110° C. to 130° C. is preferred. The reaction time varies with the catalyst and reaction conditions, but 24 hours is typically adequate. The product can be purified by any means that separates unreacted starting material from the final product, but distillation is preferred. Satisfactory yields up to 80% of theory have been obtained using about 2.7 mols of ethylene per mole of perfluoroalkyl ether iodide, a temperature of 110° C. and autogenous pressure, a reaction time of 24 hours, and purifying the product by distillation.

The perfluoroalkylether ethylene iodides (XII) are treated with oleum and hydrolyzed to provide the corresponding alcohols (XIII) according to procedures disclosed in WO 95/11877. Alternatively, the perfluoroalkylether ethyl iodides are treated with N-methyl formamide followed by ethyl alcohol/acid hydrolysis. A temperature of about 130° to 160° C. is preferred. The higher homologs (q=2, 3) of telomer ethylene iodides (XII) are available with excess ethylene at high pressure.

The telomer ethylene iodides (XII) can be treated with a variety of reagents to provide the corresponding thiols according to procedures described in J. Fluorine Chemistry, 104, 2 173-183 (2000). One example is the reaction of the telomer ethylene iodides (XII) with sodium thioacetate, followed by hydrolysis.

The telomer ethylene iodides (XII) are treated with omega-mercapto-1-alkanols according the following scheme to provide compounds of formula (XIV) wherein $R_f^3$ is $F(CF_2)_n$, n is 2 to 6, q is 1 to 6, and u is 2 to 4:

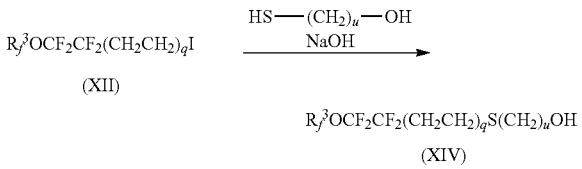

The telomer ethylene iodides (VIII) are treated with omega-mercapto-1-alkylamines according the following scheme to provide compounds of formula (XV) wherein $R_f^3$ is $F(CF_2)_n$, n is 2 to 6, q is 1 to 6, and u is 2 to 4:

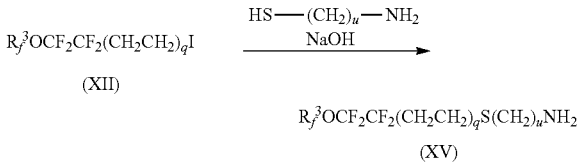

Preferred compounds of formula (XIV) and (XV) for practicing the invention are wherein q is 1, n is 4 to 6 and u is 2 to 4.

Compounds of formula (Id) are prepared by the reaction of a perfluoroalkyl vinyl ether with a diol in the presence of an alkali metal compound. Preferred ethers include those of formula $F(CF_2)_n—O—CF{=}CF_2$ wherein n is an integer of 4 to 6. Preferred diols include diethylene glycol. The diol is used at about 1 to about 15 mols per mol of ether, preferably from about 1 to about 5 mols per mol of ether. Suitable alkali metal compounds include an alkali metal, alkali earth metal, alkali hydroxide, alkali hydride, or an alkali amide. Preferred are alkali metals such as Na, K or Cs or alkali hydrides such as NaH or KH. The reaction is conducted at a temperature of from about ambient temperature to about 120° C., preferably from about 40° C. to about 120° C. The reaction can be conducted in an optional solvent, such as ether or nitrile.

To make the composition of the present invention, a fluorinated compound of formula (I), is first reacted with a polyisocyanate. The polyisocyanate reactant adds to the branched nature of the polymer. By the term "polyisocyanate" is meant di- and higher isocyanates and the term includes oligomers. Any polyisocyanate having predominately two or more isocyanate groups, or any isocyanate precursor of a polyisocyanate having predominately two or more isocyanate groups, is suitable for use in this invention. For example, hexamethylene diisocyanate homopolymers are suitable for use herein and are commercially available. It is recognized that minor amounts of diisocyanates can remain in products having multiple isocyanate groups. An example of this is a biuret containing residual small amounts of hexamethylene diisocyanate.

Also suitable for use as the polyisocyanate reactant are hydrocarbon diisocyanate-derived isocyanurate trimers. Preferred is DESMODUR N-3300 (a hexamethylene diisocyanate-based isocyanurate available from Bayer Corporation, Pittsburgh, Pa.). Other triisocyanates useful for the purposes of this invention are those obtained by reacting three moles of toluene diisocyanate with 1,1,1-tris-(hydroxymethyl)ethane or 1,1,1-tris(hydroxymethyl)propane. The isocyanurate trimer of toluene diisocyanate and that of 3-isocyanatomethyl-3,4,4-trimethylcyclohexyl isocyanate are other examples of triisocyanates useful for the purposes of this invention, as is methane-tris-(phenyl)socyanate). Precursors of polyisocyanate, such as diisocyanate, are also suitable for use in the present invention as substrates for the polyisocyanates. DESMODUR N-3600, DESMODUR Z-4470, and DESMODUR XP 2410, from Bayer Corporation, Pittsburgh, Pa., and bis-(4-isocyanatocylohexyl)methane are also suitable in the invention.

Preferred polyisocyanate reactants are the aliphatic and aromatic polyisocyanates containing biuret structures, or polydimethyl siloxane containing isocyanates. Such polyisocyanates can also contain both aliphatic and aromatic substituents.

Particularly preferred as the polyisocyanate reactant for all the embodiments of the invention herein are hexamethylene diisocyanate homopolymers commercially available, for instance as DESMODUR N-100, DESMODUR N-75 and DESMODUR N-3200 from Bayer Corporation, Pittsburgh, Pa.; 3-isocyanatomethyl-3,4,4-trimethylcyclohexyl isocyanate available, for instance as DESMODUR I (Bayer Corporation); bis-(4-isocyanatocylohexyl)methane available, for instance as DESMODUR W (Bayer Corporation) and diisocyanate trimers of formulas (IIa), (IIb), (IIc) and (IId):

(IIa)

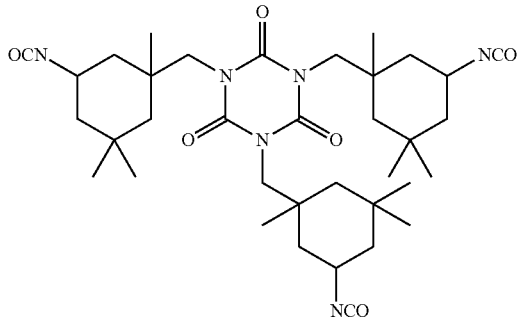

(IIb)

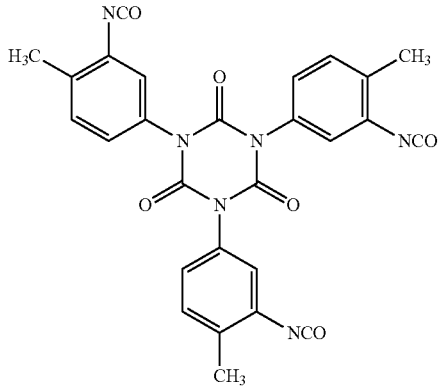

-continued (IIc)

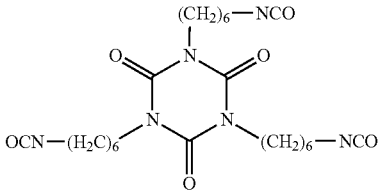

(IId)

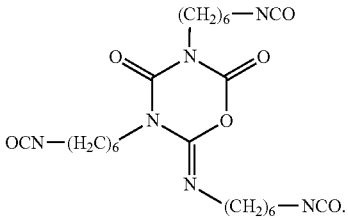

The diisocyanate trimers (IIa-d) are available, for instance as DESMODUR Z4470, DESMODUR IL, DESMODUR N-3300, and DESMODUR XP2410, respectively, from Bayer Corporation.

In a preferred embodiment, the step (i) reacting components (a) isocyanate and (b) fluorinated compound further comprises (e) a non-fluorinated organic compound selected from the group consisting of formula $$R^{10}—(R^{11})_k—X$$

wherein $R^{10}$ is a $C_1$-$C_{18}$ alkyl, a $C_1$-$C_{18}$ omega-alkenyl radical or a $C_1$-$C_{18}$ omega-alkenoyl;

$R^{11}$ is selected from the group consisting of

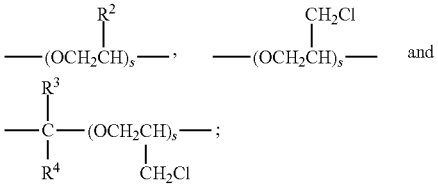

wherein $R^2$, $R^3$ and $R^4$ are each independently, H or $C_1$ to $C_6$ alkyl, and s is an integer of 1 to 50;

k is 0 or 1,

X is an isocyanate-reactive group selected from the group consisting of —OH, —N(R)H, and —SH, and R is H or $C_1$-$C_6$ alkyl. Preferably the non-fluorinated compound of formula $R^{10}—(R^{11})_k—YH$ wherein Y is O, S or N(R) reacts with about 0.1 mol % to about 60 mol % of said isocyanate groups.

In another preferred embodiment, the compound of formula $R^{10}—(R^{11})_k—YH$ comprises a hydrophilic water-solvatable material comprising at least one hydroxy-terminated polyether of formula (III):

Formula (III)

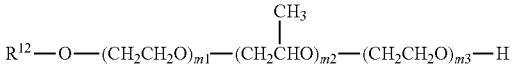

wherein $R^{12}$ is a monovalent $C_1$-$C_6$ alkyl or cycloalkyl radical; m1 is a positive integer, and m2 and m3 are each independently a positive integer or zero; said polyether having a weight average molecular weight up to about 2000. In formula (III), m1 and m3 are independently an average number of repeating oxyethylene groups, and m2 is an average number of repeating oxypropylene groups, respectively; provided that m1 is always a positive integer, while m2 and m3 are a positive integer or zero. When m2 and m3 are zero, formula (III) designates an oxyethylene homopolymer. When m2 is a positive integer and m3 is zero, formula (III) designates a block or random copolymer of oxyethylene and oxypropylene. When m2 and m3 are positive integers, formula (III) designates a triblock copolymer designated PEG-PPG-PEG (polyethylene glycol-polypropylene glycol-polyethylene glycol). Preferably, the hydrophilic, water-solvatable components are the commercially available methoxypolyethylene glycols (MPEG's), or mixtures thereof, having an average molecular weight equal to or greater than about 200, and most preferably between 350 and 2000. Also commercially available, and suitable for the preparation of the compositions of the present invention, are butoxypolyoxyalkylenes containing equal amounts by weight of oxyethylene and oxypropylene groups (Union Carbide Corp. 50-HB Series UCON Fluids and Lubricants) and having an average molecular weight greater than about 1000.

After the isocyanate and fluorinated compound are reacted, the result is reacted with water and an isocyanate-reactive fluorinated particulate component in a second step. Typically non-fluorinated particles are fluorinated prior to use in this reaction to prepare the polymers of the present invention. The particulate component suitable for use in the compositions of the invention can be any inorganic oxide particle, having isocyanate-reactive groups such as hydroxyl, amino groups, or a mixture thereof. In one embodiment the isocyanate-reactive particulate component comprises inorganic oxides of Si, Ti, Zn, Mn, Al, and Zr. Preferably the inorganic oxides have an average particle size of about 10 to about 500 nm; preferably from about 50 to about 500 nm; more preferably from about 80 to about 400 nm and more preferably from about 100 to about 300 nm. In another embodiment isocyanate-reactive particulate component is a fumed particle. In a further embodiment the isocyanate-reactive particulate component is a colloidal particle made by hydrolysis of an alkoxy silane, chlorosilane, metal alkoxide, or metal halide. Commercially available surface modified inorganic oxides useful in forming the compositions of the invention include fumed silicas under the tradename AEROSIL available from Evonik Industries, Essen, Germany; for example AEROSIL VT2640 is useful.

Specialty inorganic oxides at least partially surface-modified with hydrophobic groups, useful in the invention, can be made by synthesis. One embodiment of the invention is a composition wherein the inorganic oxides are surface modified inorganic oxide particles comprising an oxide of M atoms independently selected from the group consisting of Si, Ti, Zn, Zr, Mn, Al, and combinations thereof; at least one particle having a surface covalently bonded to at least one group represented by formula (IV)

$$(L^2)_d(L^3)_cSi—(CH_2)_n—(Z^1)_a—[C(X^1)]_x—(Z^2)_rQ^1\text{-}R_f \qquad \text{(IV)}$$

wherein:

$L^2$ is an oxygen covalently bonded to M; and each $L^3$ independently selected from the group consisting of H, a $C_1$-$C_2$ alkyl, and OH; d and c are integers such that: d is greater than or equal to 1, c is greater than or equal to 0, and d+c=3;

n is independently an integer from 1 to 12;

a, x, and l are integers chosen such that the moiety of Formula (IV) represented by $—(Z^1)_a—[C(X^1)]_x—(Z^2)_l—$ further represents at least one of the following moieties:

i) a first moiety wherein a is 1, x is 1, and l is 1;

ii) a second moiety wherein a is 1, x is 0; and l is 0; and iii) a third moiety wherein a is 1, x is 0, and l is 1;

$R_f$ is chosen from a $C_2$-$C_{12}$ perfluoroalkyl optionally interrupted by oxygen or methylene;

$Q^1$ is chosen from the group consisting of a $C_2$-$C_{12}$ hydrocarbylene optionally interrupted by at least one divalent organic group;

$X^1$ is chosen from O or S;

the first moiety further defined wherein $Z^1$ and $Z^2$ are chosen such that:

a) $Z^1$ is —NH— and $Z^2$ is from the group consisting of —NH—, —O—, —S—, $—NH—S(O)_2—$, —N[C(O)H]—, $—[HC(COOH)(R^{14})]CH—S—$, and $—(R^{14})CH—[HC(COOH)]—S—$;

b) alternatively, $Z^2$ is —NH— and $Z^1$ is from the group consisting of —O—, —S—, $—N[-Q^2-(R_f)]—$,

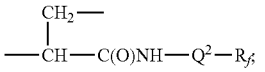

wherein $Q^2$ is independently chosen from the group consisting of a $C_2$-$C_{12}$ hydrocarbylene optionally interrupted by at least one divalent organic group;

c) $R^{14}$ is independently chosen from hydrogen, phenyl, or a monovalent $C_1$-$C_8$ alkyl optionally terminated by $—C_6H_5$, preferably $R^{14}$ is H or $CH_3$;

d) when $Z^1$ or $Z^2$ is O, $Q^1$ is interrupted by at least one divalent moiety chosen from the group consisting of —S—, —S(O)—, $—S(O)_2—$, $—NH—S(O)_2—$, $—N(CH)_3S(O)_2—$, and

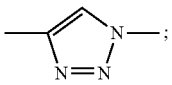

the second moiety further defined wherein:

a) $Z^1$ is independently chosen from $—N(-Q^3-R_f)—$; and b) $Q^1$ and $Q^3$ are independently chosen from the group consisting of a $C_2$-$C_{12}$ hydrocarbylene interrupted by at least one of —C(O)—O— or —O—C(O)—, and optionally further interrupted by at least one divalent organic group; and the third moiety further defined wherein:

$Z^1$ and $Z^2$ are mutually exclusive and chosen from the group consisting of $—N(Q^4)-$ and $—S(O)_2—$; $Q^4$ is a monovalent moiety chosen from the group consisting of $C_2$-$C_{12}$ alkyl, $—C_6H_5$, and $—(CH_2)_g—NH—S(O)_2—(CH_2)_g—R_f$ where g is 1 or 2.

In one embodiment the surface modified inorganic oxide particles useful in the preparation of the compositions of the invention comprise M atoms that are Si.

In another embodiment the surface modified inorganic oxide particles of formula (IV) of the first moiety wherein a is 1, x is 1, and l is 1; and $Z^1$ and $Z^2$ are both —NH—; and $X^1$ is O or S, are partially surface-modified with hydrophobic groups comprising a urea or thiourea.

The particles are prepared by reaction of the inorganic oxide and a fluorinated silane. The reaction is typically conducted in a hydrocarbon solvent, such as pentane, heptane, or iso-octane, under an inert atmosphere, such as nitrogen, with heating to a temperature of from about 50° C. to about 100° C. After several hours the product is separated by conventional means, such as centrifuging, and washed. The procedure can be repeated on the product obtained to exhaustively add to all reactive sites. Alternatively the inorganic oxide can be reacted separately with a silane and a fluorinated compound to add each sequentially to the oxide.

Preferred groups used to modify an unfluorinated particle to prepare the particle of formula (IV) include 1) isocyanate derived fluorosilanes, 2) formyl urea fluorosilanes, 3) thioether succinamic acid fluorosilanes, 4) bis-urea fluorosilanes, and 5) tertiary amine fluorosilanes. The fluorosilanes of groups 1) to 4) above are typically used to modify the first moiety of formula (IV) as defined above. The fluorosilane of group 5) is typically used to modify the second moiety of formula (IV) as defined above.

The first fluorosilane used to prepare the particles of formula (IV) is the isocyanate derived fluorosilane. This is used to prepare particles of the first moiety of formula (IV) wherein:

a is 1, x is 1, and l is 1;

$Z^1$ is —NH— and $Z^2$ is from the group consisting of —NH—, —O—, —S—, $—NH—S(O)_2—$, and —N[C(O)H]—; and alternatively, $Z^2$ is —NH— and $Z^1$ is from the group consisting of —O—, and —S—.

The isocyanate derived fluorosilane is represented by the formula (A)

$$(L^4)_3\text{-Si}—(CH_2)_n—Z^1—C(X^1)—Z^2\text{-}Q^1\text{-}R_f \quad (A)$$

wherein each $L^4$ is independently a hydrolyzable or non-hydrolyzable monovalent group, such as an alkoxy, and $Z^1$, $X^1$, $Z^2$, $Q^1$, $R_f$ and n are defined as in formula (IV); provided that when $Z^1$ or $Z^2$ is O, $Q^1$ is a $C_2$-$C_{12}$ hydrocarbylene interrupted by at least one divalent moiety chosen from the group consisting of —S—, —S(O)—, $—S(O)_2—$, $—NH—S(O)_2—$, $—N(CH)_3S(O)_2—$, and

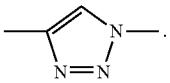

Examples of fluorosilanes of formula (A) include A) to D) below:

A) a urea or thiourea fluorosilane wherein $Z^1$ and $Z^2$ are both —NH—; said urea or thiourea fluorosilane represented by the formula:

$$(L^4)_3Si—(CH_2)_n—NH—C(X^1)—NH\text{-}Q^1\text{-}R_f$$

wherein:

$X^1$ is O to form a urea, or $X^1$ is S to form a thiourea; and $Q^1$ is independently chosen from the group consisting of a $C_2$-$C_{12}$ hydrocarbylene optionally interrupted by at least one divalent moiety chosen from the group consisting of —S—, —S(O)—, $—S(O)_2—$, and —O—C(O)—NH —;

B) a carbamate fluorosilane wherein $Z^1$ is —NH— and $Z^2$ is —O— or $Z^1$ is —O— and $Z^2$ is —NH—; and $X^1$ is O; said carbamate fluorosilane represented by the formulae:

$$(L^4)_3Si—(CH_2)_n—NH—C(O)—O\text{-}Q^1\text{-}R_f, \text{ or}$$

$$(L^4)_3Si—(CH_2)_n—O—C(O)—NH\text{-}Q^1\text{-}R_f$$

wherein:

$Q^1$ is a $C_2$-$C_{12}$ hydrocarbylene interrupted by at least one divalent moiety chosen from the group consisting of —NH—C(O)—NH—, —NH—C(S)—NH—, —S—, —S(O)—, —$S(O)_2$—, —$(R^1)$N—$S(O)_2$—,

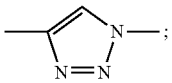

C) a thiolcarbamate fluorosilane wherein $Z^1$ is —NH— and $Z^2$ is —S—, or $Z^1$ is —S— and $Z^2$ is —NH—; and $X^1$ is O; said thiocarbamate represented by the formulae:

$$(L^4)_3Si—(CH_2)_n—NH—C(O)—S-Q^1-R_f \text{ or}$$

$$(L^4)_3Si—(CH_2)_n—S—C(O)—NH-Q^1-R_f$$

wherein:

$Q^1$ is independently chosen from the group consisting of a $C_2$-$C_{12}$ hydrocarbylene optionally interrupted by at least one divalent moiety chosen from the group consisting of —S—, —S(O)—, —$S(O)_2$—, —N$(R^1)$—C(O)—, —C(O)—N$(R^1)$—, —$(R^1)$N—$S(O)_2$—, and

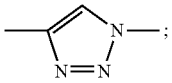

or

D) a N-sulfone urea fluorosilane wherein $Z^1$ is —NH—, and $Z^2$ is —NH—$S(O)_2$—; and $X^1$ is O; said N-sulfone urea fluorosilane represented by the formula:

$$(L^4)_3Si—(CH_2)_n—NH—C(O)—NH—S(O)_2-Q^1-R^f$$

wherein:

$Q^1$ is independently chosen from the group consisting of an uninterrupted $C_2$-$C_{12}$ hydrocarbylene.

The second fluorosilane used to prepare particles of formula (IV) is a formyl urea fluorosilane. This is used to prepare particles of formula (IV) wherein:

a is 1, x is 1, and l is 1; and $Z^1$ is —NH—, and $Z^2$ is —N[C(O)H]—.

The formyl urea fluorosilane is represented by the formula (B)

$$(L^4)_3Si—(CH_2)_n—NH—C(X^1)—N[C(O)H]-Q^1-R_f \quad (B)$$

wherein:

each $L^4$ is independently a hydrolyzable or non-hydrolyzable monovalent group, such as an alkoxy;

$Q^1$ is independently chosen from the group consisting of a $C_2$-$C_{12}$ hydrocarbylene interrupted by at least one divalent moiety chosen from the group consisting of —S— and —NH—; and $X^1$, $R_f$ and n are defined as in formula (IV).

The third fluorosilane used to prepare particles of formula (IV) is a thioether succinamic acid fluorosilane. This is used to prepare particles of formula (IV) wherein:

a is 1, x is 1, and l is 1;

$Z^1$ is —NH— and $Z^2$ is —[HC(COOH)$(R^1)$]CH—S— or —$(R^1)$CH—[HC(COOH)]—S—;

X is O; and $Q^1$ is —$(CH_2)_2$—.

The thioether succinamic acid is represented by the formulae (C1) or (C2):

$$(L^4)_3Si—(CH_2)_n—NH—C(X^1)—[HC(COOH)(R^1)]CH—S—(CH_2)_2—R_f \quad (C1) \text{ or}$$

$$(L^4)_3Si—(CH_2)_n—NH—C(X^1)—(R^1)CH—[HC(COOH)]—S—(CH_2)_2—R_f \quad (C2)$$

wherein each $L^4$ is independently a hydrolyzable or non-hydrolyzable monovalent group, such as an alkoxy; and $X^1$, $R^1$, $R_f$ and n are defined as in formula (IV).

The fourth fluorosilane used to prepare particles of formula (IV) is bis-urea fluorosilane. This is used to prepare particles of formula (IV) wherein:

a is 1, x is 1, and l is 1; and $Z^1$ is —N[-$Q^2$-$(R_f)$]—; $Z^2$ is —NH—.

The bis-urea fluorosilane is represented by the formula (D):

(D)

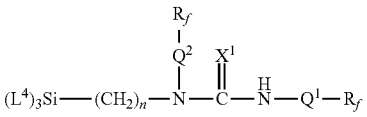

wherein:

each $L^4$ is independently a hydrolyzable or non-hydrolyzable monovalent group, such as an alkoxy;

$Q^1$ and $Q^2$ are each independently chosen from the group consisting of a $C_2$-$C_{12}$ hydrocarbylene optionally interrupted by at least one divalent moiety chosen from the group consisting of —S—, —S(O)—, —$S(O)_2$—; provided that $Q^2$ is interrupted by at least one by at least one urea group represented by —HN—C(O)—NH—; and $X^1$, $R_f$ and n are defined as in formula (IV).

The fifth fluorosilane used to prepare particles of formula (IV) is a tertiary amine fluorosilane. This fluorosilane is used to prepare particles of formula (IV) wherein:

a is 1, x is 0; and l is 0; and $Z^1$ is —N[-$Q^3$-$(R_f)$]—.

The tertiary amine fluorosilane is represented by the formula (E)

(E)

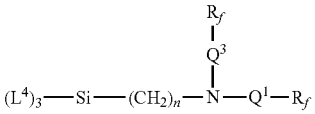

wherein each $L^4$ is independently a hydrolyzable or non-hydrolyzable monovalent group, such as an alkoxy;

$Q^1$ and $Q^3$ are each independently chosen from the group consisting of a $C_2$-$C_{12}$ hydrocarbylene interrupted by at least one —C(O)—O— and optionally further interrupted by at least one divalent moiety chosen from the group consisting of —S—, —S(O)—, —$S(O)_2$—, —N$(R^1)$—C(O)—, —C(O)—N$(R^1)$—, —$(R^1)$N—$S(O)_2$—, and

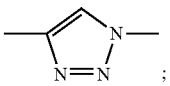

and $R_f$ and n are defined as in formula (IV).

The fluorosilanes of formulae (A) through (E) are prepared by the following reactions.

Isocyanate derived fluorosilanes of formula (A) can be made by reacting an isocyanate or isothiocyanate with any one of an amine, an alcohol or thiol. For example, an isocyanate terminated silane or isothiocyanate, as represented by $(L^4)_3$-Si—$(CH_2)_n$—N═C═$X^1$, can be reacted with a fluoroalkyl terminated by amine, alcohol, thiol, or sulfonamine, as represented by $HZ^2$-$Q^1$-$R_f$ (wherein $Z^2$ is —NH—, —O—, —S—, or —NH—$S(O)_2$—). Conversely, a silane terminated by amine, alcohol, thiol, or sulfonamine, as represented by $(L^4)_3$-Si—$(CH_2)_n$—$Z^1$H (wherein $Z^1$ is —NH—, O, or S), can be reacted with a fluoroalkyl terminated by isocyanate or isothiocyanate, as represented by $X^1$═C═N-$Q^1$-$R_f$.

A urea fluorosilane (Example A above) wherein $X^1$ is O; and $Z^1$ and $Z^2$ are both —NH—; said urea fluorosilane represented by $(L^4)_3$Si—$(CH_2)_n$—NH—C(O)—NH-$Q^1$-$R_f$, can be made by reacting an isocyanate with an amine. For example, an isocyanate terminated silane, as represented by $(L^4)_3$-Si—$(CH_2)_n$—N═C═O, can be reacted with an amine terminated fluoroalkyl, as represented by $H_2N$-$Q^1$-$R_f$. Conversely, an amine terminated silane, as represented by $(L^4)_3$-Si—$(CH_2)_n$—$NH_2$, can be reacted with an isocyanate terminated fluoroalkyl, as represented by O═C═N-$Q^1$—$R_f$.

A thiourea fluorosilane (Example A above) wherein $X^1$ is S; and $Z^1$ and $Z^2$ are both —NH—; said thiourea fluorosilane represented by $(L^4)_3$Si—$(CH_2)_n$—NH—C(S)—NH-$Q^1$-$R_f$, can be made by reacting an isothiocyanate with an amine. For example, a isothiocyanate terminated silane, as represented by $(L^4)_3$-Si—$(CH_2)_n$—N═C═S [Synthesis see U.S. Pat. No. 5,616,762] can be reacted with an amine terminated fluoroalkyl, as represented by $H_2N$-$Q^1$-$R_f$. Conversely, an amine terminated silane, as represented by $(L^4)_3$-Si—$(CH_2)_n$—$NH_2$, can be reacted with a isothiocyanate terminated fluoroalkyl, as represented by S═C═N-$Q^1$-$R_f$.

A carbamate fluorosilane (Example B above) wherein $X^1$ is O; and $Z^1$ is —NH— and $Z^2$ is —O—, or $Z^1$ is —O— and $Z^2$ is —NH—; said carbamate fluorosilane represented by the formulae: $(L^4)_3$Si—$(CH_2)_n$—NH—C(O)—O-$Q^1$-$R_f$ or $(L^4)_3$Si—$(CH_2)_n$—O—C(O)—NH-$Q^1$-$R_f$ can be made by reacting an isocyanate with an alcohol in the presence of a catalyst such as dibutyltin dilaurate, iron trichloride, or tetraethoxy titanium. For example, an isocyanate terminated silane, as represented by $(L^4)_3$-Si—$(CH_2)_n$—N═C═O, can be reacted with an alcohol terminated fluoroalkyl, as represented by HO-$Q^1$-$R_f$. Conversely, an alcohol terminated silane, as represented by $(L^4)_3$-Si—$(CH_2)_n$—OH, can be reacted with an isocyanate terminated fluoroalkyl, as represented by O═C═N-$Q^1$-$R_f$. Preferably, carbamate fluorosilanes are made by reacting an isocyanate terminated silane, as represented by HO-$Q^1$-$R_f$, with an alcohol terminated fluoroalkyl chosen from the group of sulfonamido alcohols and alcohol terminated triazoles. Preferred sulfonamido alcohols include those represented by: HO—$(CH_2)_t$—HN—$S(O)_2$—$(CH_2)_t$—$R_f$, HO—$(CH_2)_t$—N($CH_3$)—$S(O)_2$—$(CH_2)_t$—$R_f$, HO—$(CH_2)_t$—($CH_3$—$CH_2$—)N—$S(O)_2$—$(CH_2)_t$—$R_f$, and HO—$(CH_2)_t$—($CH_3$—$CH_2$—$CH_2$—)N—$(CH_2)_t$—$R_f$; wherein t is independently 1, 2, or 3. Preferred alcohol terminated triazoles include those represented by

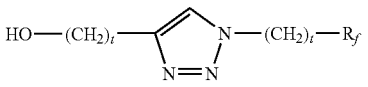

wherein t is independently 1, 2, or 3.

A thiolcarbamate fluorosilane (Example C above) wherein $X^1$ is O; and $Z^1$ is —NH— and $Z^2$ is —S—, or $Z^1$ is —S— and $Z^2$ is —NH—; said thiolcarbamate fluorosilane represented by the formulae: $(L^4)_3$Si—$(CH_2)_n$—NH—C(O)—S-$Q^1$-$R_f$ or $(L^4)_3$Si—$(CH_2)_n$—S—C(O)—NH-$Q^1$-$R_f$, can be made by reacting an isocyanate with a thiol in the presence of a catalyst such as dibutyltin dilaurate, iron trichloride, or tetraethoxytitanium. For example, an isocyanate terminated silane, as represented by $(L^4)_3$-Si—$(CH_2)_n$—N═C═O, can be reacted with a thiol terminated fluoroalkyl, as represented by HS-$Q^1$-$R_f$. Conversely, a thiol terminated silane, as represented by $(L^4)_3$-Si—$(CH_2)_n$—SH, can be reacted with an isocyanate terminated fluoroalkyl, as represented by O═C═N-$Q^1$-$R_f$.

A N-sulfone urea fluorosilane (Example D above) represented by $(L^4)_3$Si—$(CH_2)_n$—NH—C(O)—NH—$S(O)_2$-$Q^1$-$R_f$ wherein $Q^1$ is independently chosen from the group consisting of an uninterrupted $C_2$-$C_{12}$ hydrocarbylene can be made by reacting an isocyanate terminated silane, as represented by $(L^4)_3$-Si—$(CH_2)_n$—N═C═O, with a sulfonamine terminated fluoroalkyl, as represented by $NH_2$—$S(O)_2$-$Q^1$-$R_f$.

The formyl urea fluorosilane represented by formula (B), $(L^4)_3$Si—$(CH_2)_n$—NH—C($X^1$)—N[C(O)H]-$Q^1$-$R_f$, wherein $Q^1$ is a $C_2$-$C_{12}$ hydrocarbylene interrupted by at least one divalent moiety chosen from the group consisting of —S— and —NH—, can be made by reacting a silane terminated isocyanate, represented by $(L^4)_3$-Si—$(CH_2)_n$—N═C═O, with an N-vinylformamide fluoroalkyl, represented by HN[C(O)H]-$Q^1$-$R_f$, in the presence of a catalyst such as dibutyltin dilaurate, iron trichloride, or tetraethoxy titanium.

The thioether succinamic acid fluorosilane represented by the formulae (C1) or (C2), $(L^4)_3$Si—$(CH_2)_n$—NH—C(O)—[HC(COOH)($R^1$)]$CR^1$—$(CH_2)_m$—S—$(CH_2)_2$—$R_f$, or $(L^4)_3$Si—$(CH_2)_n$—NH—C(O)—($R^1$)CH—[$CR^1$(COOH)]—$(CH_2)_m$—S—$(CH_2)_2$—$R_f$ wherein m 1 or 0, each $R^1$ is independently chosen from methyl or hydrogen, can be made by reacting an amine terminated silane, as represented by $(L^4)_3$-Si—$(CH_2)_n$—$NH_2$, check with a succinic anhydride terminated fluoroalkyl, as represented by

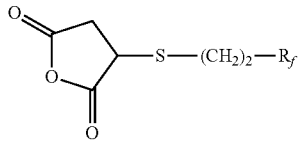

thereby yielding an isomeric mixture of thioether succinamic acid fluorosilanes represented by the formulae above.

The bis-urea fluorosilanes represented by the formula (D), (D)

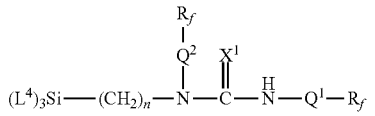

can be made by reacting a succinic anhydride terminated fluorosilane, as represented by

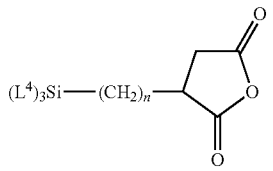

with an amide terminated fluoroalkyl, as represented by $H_2N$-$Q^1$-$R_f$, should this be $H_2N$-$Q^2$-$R_f$ thereby yielding an intermediate product represented by

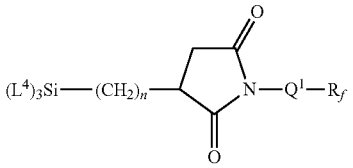

This intermediate can then be reacted with an amide terminated fluoroalkyl, as represented by $H_2N$-$Q^1$-$R_f$, thereby yielding a bis-urea fluorosilane.

The tertiary amine fluorosilane represented by the formula (E)

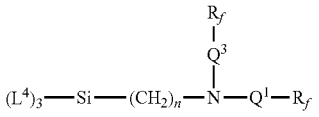

(E)

can be made by the Michael reaction of one molar equivalent of an amino silane represented by $(L^4)_3Si—(CH_2)_n—NH_2$ with two molar equivalents of a vinyl terminated fluoroalkyl selected from $Q^6$-$R_f$ or $Q^7$-$R_f$ or a mixture thereof wherein $Q^6$ and $Q^7$ are independently selected from a vinyl terminated a $C_2$-$C_{12}$ hydrocarbylene interrupted by at least one —C(O)—O—, and optionally further interrupted by at least one divalent moiety chosen from the group consisting of —S—, —S(O)—, —$S(O)_2$—, —N($R^1$)—C(O)—, —C(O)—N($R^1$)—, —($R^1$)N—$S(O)_2$—, and

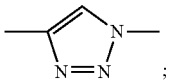

;

wherein $R^1$ is hydrogen, phenyl, or a monovalent $C_1$-$C_8$ alkyl optionally terminated by —$C_6H_5$, preferably H or $CH_3$. One example of $Q^6$-$R_f$ or $Q^7$-$R_f$ is $CH_2$=$CH_2$—C(O)—O—$(CH_2)_2$—$R_f$ The conditions of Michael reaction are well known in the art and, in accordance with the invention, can involve a solvent such as ethanol and stirring at elevated temperatures (e.g. about 60° C.) for an extended period of time (e.g. about 5 hours).

In another embodiment the step (ii) reacting with (c) water and (d) the 0.05 to about 2.0% by weight of isocyanate-reactive fluorinated particulate component, further comprises (f) a linking agent. Linking agents useful in forming compositions of the invention are organic compounds having two or more zerewitinoff hydrogen atoms (Zerevitinov, Th., Quantitative Determination of the Active Hydrogen in Organic Compounds, Berichte der Deutschen Chemischen Gesellschaft, 1908, 41, 2233-43). Examples include compounds that have at least two functional groups that are capable of reacting with an isocyanate group. Such functional groups include hydroxyl, amino and thiol groups. Examples of polyfunctional alcohols useful as linking agents include: polyoxyalkylenes having 2, 3 or 4 carbon atoms in the oxyalkylene group and having two or more hydroxyl groups, for instance, polyether diols such as polyethylene glycol, polyethylene glycol-polypropylene glycol copolymers, and polytetramethylene glycol; polyester diols, for instance, the polyester diols derived from polymerization of adipic acid, or other aliphatic diacids, and organic aliphatic diols having 2 to 30 carbon atoms; non-polymeric polyols including alkylene glycols and polyhydroxyalkanes including 1,2-ethanediol, 1,2-propanol diol, 3-chloro-1,2-propanediol, 1,3-propanediol, 1,3-butanediol, 1,4-butanediol, 2,2-dimethyl-1,3-propanediol, 1,2-, 1,5-, and 1,6-hexanediol, 2-ethyl-1,6-hexanediol, 1,8-octanediol, 1,10-decanediol, glycerine, trimethylolethane, trimethylolpropane, 2-ethyl-2-(hydroxymethyl)-1,3-propanediol, 1,2,6-hexanetriol, and pentaerythritol.

Preferred linking agents are diamines and polyamines. Preferred polyfunctional amines useful as linking agents include: amine terminated polyethers such as, for example, JEFFAMINE D400, JEFFAMINE ED, and JEFFAMINE EDR-148, all from Huntsman Chemical Company, Salt Lake City, Utah; aliphatic and cycloaliphatic amines including amino ethyl piperazine, 2-methyl piperazine, 4,4'-diamino-3,3'-dimethyl dicyclohexylmethane, 1,4-diaminocyclohexane, 1,5-diamino-3-methylpentane, isophorone diamine, ethylene diamine, diethylene triamine, triethylene tetraamine, triethylene pentamine, ethanol amine, lysine in any of its stereoisomeric forms and salts thereof, hexane diamine, and hydrazine piperazine; and arylaliphatic amines such as xylylenediamine and a,a,a',a'-tetramethylxylylenediamine.

Mono- and di-alkanolamines that can be used as linking agents include: monoethanolamine, monopropanolamine, diethanolamine, dipropanolamine, and the like.

The compositions of the present invention are made by incorporating the particulate component into the synthesis of the polymer. At least one diisocyanate, polyisocyanate, or mixture thereof, having isocyanate groups, and at least one fluorinated compound selected from the formula (I) are reacted. This reaction is typically conducted by charging a reaction vessel with the polyisocyanate; a fluoroalkyl alcohol, thiol, amine, or mixture thereof, and optionally, the non-fluorinated organic compound of formula $R^{10}/R^{11}$ k)$_k$YH. The order of reagent addition is not critical. The specific weight of the polyisocyanate and other reactants charged is based on their equivalent weights and on the working capacity of the reaction vessel, and is adjusted so that the alcohol, thiol or amine, will be consumed in the first step. A suitable dry organic solvent free of groups that react with isocyanate groups is typically used as a solvent. Ketones are the preferred solvents, and methylisobutylketone (MIBK) is particularly preferred for convenience and availability. The charge is agitated and temperature adjusted to about 40° C.-70° C. Typically a catalyst such as a titanium chelate in an organic solvent is then added, typically in an amount of from about 0.01 to about 1.0 weight % based on the dry weight of the composition, and the temperature is raised to about 80° C.-100° C. This initial reaction is conducted so that less than 100% of the polyisocyanate groups are reacted. After holding for several hours, additional solvent, water, the isocyanate-reactive particulate component, and optionally a linking agent, are added, and the mixture allowed to react for several more hours or until all of the isocyanate has been reacted. More water can then be added along with surfactants, if desired, and stirred until thoroughly mixed. Following homogenization, the organic solvent can be removed by evaporation at reduced pressure, and the remaining aqueous solution or dispersion of the product polymer used as is or subjected to further processing.

The resulting composition can be diluted with water, or further dispersed or dissolved in a solvent selected from the groups comprising simple alcohols and ketones that are suitable as the solvent for final application to substrates, hereinafter the "application solvent".

Alternatively, an aqueous dispersion, made by conventional methods with surfactants, is prepared by removing solvents by evaporation and the use of emulsification or homogenization procedures known to those skilled in the art. Surfactants may include anionic, cationic, nonionic, or blends. Such solvent-free emulsions are preferred to minimize flammability and volatile organic compounds (VOC) concerns.

The final product for application to a substrate is a dispersion (if water based) or a solution (if solvents other than water are used) of the product polymer.

Preferred polymers of the invention are wherein $R_f$ has 4 to 6 carbon atoms, p and q is 1 and r is 0. Other preferred embodiments are polymers wherein said fluorinated compound reacts with about 5 mol % to about 90 mol %, and more preferably about 10 mol % to about 70 mol %, of said isocyanate groups. Other preferred embodiments are polymers wherein the linking group is a diamine or polyamine.

It will be apparent to one skilled in the art that many changes to any or all of the above procedures can also be used to optimize the reaction conditions for obtaining maximum yield, productivity or product quality.

The present invention further comprises a method of providing water repellency, oil repellency and soil resistance to a substrate comprising contacting the polymers of the invention as solutions or dispersions with a substrate. Suitable substrates include fibrous or hard surface substrates as defined below.

The solution or dispersion of the composition of the present invention as described above is contacted with the substrate by any suitable method. Such methods include, but are not limited to, application by exhaustion, foam, flex-nip, nip, pad, kiss-roll, beck, skein, winch, liquid injection, overflow flood, roll, brush, roller, spray, dipping, immersion, and the like. The composition is also contacted by use of a beck dyeing procedure, continuous dyeing procedure or threadline application.

The solution or dispersion is applied to the substrate as such, or in combination with other optional textile finishes or surface treating agents. Such optional additional components include treating agents or finishes to achieve additional surface effects, or additives commonly used with such agents or finishes. Such additional components comprise compounds or compositions that provide surface effects such as no iron, easy to iron, shrinkage control, wrinkle free, permanent press, moisture control, softness, strength, anti-slip, anti-static, anti-snag, anti-pill, stain repellency, stain release, soil repellency, soil release, water repellency, oil repellency, odor control, antimicrobial, sun protection, cleanability and similar effects. One or more of such treating agents or finishes are applied to the substrate before, after, or simultaneously with the composition of the present invention. For example for fibrous substrates, when synthetic or cotton fabrics are treated, use of a wetting agent can be desirable, such as ALKANOL 6112 available from E. I. du Pont de Nemours and Company, Wilmington, Del. When cotton or cotton-blended fabrics are treated, a wrinkle-resistant resin can be used such as PERMAFRESH EFC available from Omnova Solutions, Chester, S.C.

Other additives commonly used with such treating agents or finishes are also optionally present such as surfactants, pH adjusters, cross linkers, wetting agents, wax extenders, and other additives known by those skilled in the art. Suitable surfactants include anionic, cationic, nonionic, N-oxides and amphoteric surfactants. Preferred is an anionic surfactant such as sodium lauryl sulfate, available as DUPONOL WAQE or SUPRALATE WAQE from Witco Corporation, Greenwich, Conn., or SUPRALATE WAQE available from Witco, Houston Tex. Examples of such additives include processing aids, foaming agents, lubricants, anti-stains, and the like. The composition is applied at a manufacturing facility, retailer location, or prior to installation and use, or at a consumer location.

Optionally a blocked isocyanate to further promote durability is added with the composition of the present invention (i.e., as a blended composition). An example of a suitable blocked isocyanate to use in the present invention is HYDROPHOBOL XAN available from Ciba Specialty Chemicals, High Point, N.J. Other commercially available blocked isocyanates are also suitable for use herein. The desirability of adding a blocked isocyanate depends on the particular application for the copolymer. For most of the presently envisioned applications, it does not need to be present to achieve satisfactory cross-linking between chains or bonding to the substrate. When added as a blended isocyanate, amounts up to about 20% by weight are added.

Optionally, nonfluorinated extender compositions are also included in the application composition to potentially further increase fluorine efficiency. Examples of such optional additional extender polymer compositions include hydrocarbon copolymers of acrylates, methacrylates, or mixtures thereof. Such copolymers can also include vinylidene chloride, vinyl chloride, vinyl acetate, or mixtures thereof.

The optimal treatment for a given substrate depends on (1) the characteristics of the fluorinated polymer of the present invention, (2) the characteristics of the surface of the substrate, (3) the amount of fluorinated polymer applied to the surface, (4) the method of application of the fluorinated polymer onto the surface, and many other factors. Some fluorinated polymer repellents work well on many different substrates and are repellent to oil, water, and a wide range of other liquids. Other fluorinated polymer repellents exhibit superior repellency on some substrates or require higher loading levels.

The present invention further comprises substrates treated with the solution or dispersion of the composition of the present invention as described above. Suitable substrates include fibrous substrates. The fibrous substrates include fibers, yarns, fabrics, fabric blends, textiles, nonwovens, paper, leather, and carpets. These are made from natural or synthetic fibers including cotton, cellulose, wool, silk, rayon, nylon, aramid, acetate, acrylic, jute, sisal, sea grass, coir, polyamide, polyester, polyolefin, polyacrylonitrile, polypropylene, polyaramid, or blends thereof. By "fabric blends" is meant fabric made of two or more types of fibers. Typically these blends are a combination of at least one natural fiber and at least one synthetic fiber, but also can include a blend of two or more natural fibers or of two or more synthetic fibers. Carpet substrates can be dyed, pigmented, printed, or undyed. Carpet substrates can be scoured or unscoured. Substrates to which it is particularly advantageous to be treated with the method of the present invention so as to impart soil resistant and soil release properties include those prepared from polyamide fibers (such as nylon), cotton and blends of polyester and cotton, particularly such substrates being used in tablecloths, garments, washable uniforms and the like. The nonwoven substrates include, for example, spunlaced nonwovens, such as SONTARA available from E. I. du Pont de Nemours and Company, Wilmington, Del., and spunbonded-meltblown-spunbonded nonwovens. The treated substrates of the present invention have one or more of excellent water repellency, oil repellency, soil resistance, soil release, stain resistance and stain release.

The compositions and method of the present invention are useful to provide excellent water repellency, oil repellency, and soil resistance to treated substrates. The surface properties are obtained using a polymer containing a particulate component and a perfluoroalkyl group of from about 2 to about 8 carbons, preferably from about 2 to about 6 carbons. The presence of the particulate component in the polymer structure in very small amounts has been found to result in the ability to impart excellent surface effect properties to substrates despite the shorter perfluoroalkyl chain length. The treated substrates of the present invention are useful in a variety of applications and products such as clothing, protective garments, carpet, upholstery, furnishings, and other uses. The excellent surface properties described above help to maintain surface cleanliness and therefore can permit longer use.

Materials and Test Methods

Test Methods

Test Method 1—Water Repellency

The water repellency of a treated substrate was measured according to AATCC standard Test Method No. 193-2004 and the DuPont Technical Laboratory Method as outlined in the TEFLON Global Specifications and Quality Control Tests information packet. The test determines the resistance of a treated substrate to wetting by aqueous liquids. Drops of water-alcohol mixtures of varying surface tensions are placed on the substrate and the extent of surface wetting is determined visually. The higher the water repellency rating, the better the resistance of a finished substrate to staining by water-based substances. The composition of water repellency test liquids is shown in Table 1.

TABLE 1

Water Repellency Test Liquids

| Water Repellency | Composition, Vol. % | |
|---|---|---|
| Rating Number | Isopropyl Alcohol | Distilled Water |
| 1 | 2 | 98 |
| 2 | 5 | 95 |
| 3 | 10 | 90 |
| 4 | 20 | 80 |
| 5 | 30 | 70 |
| 6 | 40 | 60 |
| 7 | 50 | 50 |
| 8 | 60 | 40 |
| 9 | 70 | 30 |
| 10 | 80 | 20 |
| 11 | 90 | 10 |
| 12 | 100 | 0 |

Testing procedure: Three drops of Test Liquid 1 are placed on the treated substrate. After 10 seconds, the drops are removed by using vacuum aspiration. If no liquid penetration or partial absorption (appearance of a darker wet patch on the substrate) is observed, the test is repeated with Test Liquid 2. The test is repeated with Test Liquid 3 and progressively higher Test Liquid numbers until liquid penetration (appearance of a darker wet patch on the substrate) is observed. The test result is the highest Test Liquid number that does not penetrate into the substrate. Higher scores indicate greater repellency.

Test Method 2—Oil Repellency

The treated samples were tested for oil repellency by a modification of AATCC standard Test Method No. 118, conducted as follows. A substrate treated with an aqueous dispersion of polymer as previously described, is conditioned for a minimum of 2 hours at 23° C. and 20% relative humidity and 65° C. and 10% relative humidity. A series of organic liquids, identified below in Table 2, are then applied dropwise to the samples. Beginning with the lowest numbered test liquid (Repellency Rating No. 1), one drop (approximately 5 mm in diameter or 0.05 mL volume) is placed on each of three locations at least 5 mm apart. The drops are observed for 30 seconds. If, at the end of this period, two of the three drops are still spherical in shape with no wicking around the drops, three drops of the next highest numbered liquid are placed on adjacent sites and similarly observed for 30 seconds. The procedure is continued until one of the test liquids results in two of the three drops failing to remain spherical to hemispherical, or wetting or wicking occurs.

The oil repellency rating is the highest numbered test liquid for which two of the three drops remained spherical to hemispherical, with no wicking for 30 seconds. In general, treated samples with a rating of 5 or more are considered good to excellent; samples having a rating of one or greater can be used in certain applications.

TABLE 2

Oil Repellency Test Liquids

| Oil Repellency Rating Number | Test Solution |
|---|---|
| 1. | NUJOL Purified Mineral Oil |
| 2. | 65/35 NUJOL/n-hexadecane (v/v) at 21° C. |
| 3. | n-hexadecane |
| 4. | n-tetradecane |
| 5. | n-dodecane |
| 6. | n-decane |
| 7. | n-octane |
| 8. | n-heptane |

Note:
NUJOL is a trademark of Plough, Inc., for a mineral oil having a Saybolt viscosity of 360/390 at 38° C. and a specific gravity of 0.880/0.900 at 15° C.

Test Method 3—Accelerated Soiling Drum Test

A drum mill (on rollers) was used to tumble synthetic soil onto carpet samples. Synthetic soil was prepared as described in AATCC Test Method 123-2000, Section 8. Soil-coated beads were prepared as follows. Synthetic soil, 3 g, and 1 liter of clean nylon resin beads SURLYN ionomer resin beads, ⅛-3/16 inch (0.32-0.48 cm) diameter, were placed into a clean, empty canister. SURLYN is an ethylene/methacrylic acid copolymer, available from E. I. du Pont de Nemours and Co., Wilmington, Del. The canister lid was closed and sealed with duct tape and the canister rotated on rollers for 5 min. The soil-coated beads were removed from the canister.

Carpet samples to insert into the drum were prepared as follows. Total carpet sample size was 8×25 inch (20.3×63.5 cm) for these tests. The carpet pile of all samples was laid in the same direction. The shorter side of each carpet sample was cut in the machine direction (with the tuft rows). Strong adhesive tape was placed on the backside of the carpet pieces to hold them together. The carpet samples were placed in the clean, empty drum mill with the tufts facing toward the center of the drum. The carpet was held in place in the drum mill with rigid wires. Soil-coated resin beads, 250 cc, and 250 cc of ball bearings (5/16 inch, 0.79 cm diameter) were placed into the drum mill. The drum mill lid was closed and sealed with duct tape. The drum was run on the rollers for 2½ min at 105 revolutions per minute (rpm). The rollers were stopped and the direction of the drum mill reversed. The drum was run on the rollers for an additional 2½ minutes at 105 rpm. The carpet samples were removed and vacuumed uniformly to removes excess dirt. The soil-coated beads were discarded.

The ΔE color difference for the soiled carpet was measured for the test and control items versus the original unsoiled carpet. Color measurement of each carpet was conducted on the carpet following the accelerated soiling test. For each control and test sample the color of the carpet was measured, the sample was soiled, and the color of the soiled carpet was measured. The ΔE is the difference between the color of the soiled and unsoiled samples, expressed as a positive number. The color difference was measured on each item, using a Minolta Chroma Meter CR-410. Color readings were taken at five different areas on the carpet sample, and the average ΔE was recorded. The control carpet for each test item was of the same color and construction as the test item. A lower ΔE indicates less soiling and superior soil repellency. The ΔΔE represents the difference of the soil resistance from one example to another. A positive number for ΔΔE indicates the superior soil resistance of one example to another and vice versa.

Materials $C_6F_{13}(CH_2CF_2)_2I$ was prepared by reacting perfluorohexyl iodide (available from E. I. du Pont de Nemours and Company, Wilmington Del.) and vinylidene fluoride (available from E. I. du Pont de Nemours and Company, Wilmington Del.) as described by Balague, et al, "Synthesis of Fluorinated Telomers, Part 1, Telomerization of Vinylidene Fluoride with Perfluoroalkyl Iodides", J. Fluorine Chem. (1995), 70(2), 215-23. The specific telomer iodides are isolated by fractional distillation.

All other chemicals used were commercially available from Thermo Fisher Scientific, Pittsburgh, Pa. unless otherwise stated.

The particles useful in the present invention were modified prior to use to fluorinated reactive particles by the procedures described below. While the example below indicates one specific modified particle, it is understood that many combinations exist and the present invention is not to be limited by the illustrative example described herein.

Under nitrogen, thiourea (1.1 equivalents) and 1-iodo-2-perfluorohexylethane (1 equivalent) were added to a degassed mixture of dimethoxyethane (DME, 9 parts) and water (1 part). The reaction mixture was held at reflux temperature for 8 h. Most of the DME was distilled off and the distillation residue was allowed to cool to ambient temperature. Under stirring a solution of sodium methoxide in methanol (1 molar, 1.1 equivalents) was added to the suspension. Degassed water was added to the mixture. The desired product, 1-(1H,1H,2H,2H-perfluorooctyl) thiol ($C_6F_{13}C_2H_4SH$) was collected quantitatively as the fluorous bottom layer.

A solution of one equivalent of 1-(1H,1H,2H,2H-perfluorooctyl)thiol, one equivalent of N-vinylformamide, and 0.04 parts VAZO 64 available from E. I. du Pont de Nemours and Company, Wilmington, Del., in inhibitor-free tetrahydrofuran (THF) was slowly warmed to 65° C. An exotherm occurred at 45° C., and increased the reaction temperature briefly to 70° C. The reaction was stirred at 65° C. until complete consumption of the thiol was indicated (GC/MS monitoring, 5 h). All volatiles were removed under reduced pressure to furnish the desired amide, $C_6F_{13}C_2H_4SCH_2CH_2NHC(O)H$, as an off-white solid.

Concentrated hydrogen chloride solution (37.5% by weight in water, ten-fold excess) was added to a solution of one equivalent of either $C_6F_{13}C_2H_4SCH_2CH_2NHC(O)H$ in ethanol at 0° C. (32° F.). The reaction mixture was allowed to warm to ambient temperature while being stirred. After the initial foam formation ceased the reaction mixture was slowly heated and held at reflux temperature for 5 h. The progress of the reaction was monitored via gas chromatography. Upon complete conversion the pH of the solution was brought to 8-10 by carefully adding aqueous sodium hydroxide solution. The crude product separated as the bottom layer and was isolated as a dark brown slightly viscous liquid via a separatory funnel. It was washed with water and dried using molecular sieves (4 angstrom) to give the desired product $C_6F_{13}C_2H_4SCH_2CH_2NH_2$.

$C_6F_{13}C_2H_4SCH_2CH_2NH_2$ was purified by distillation and obtained as a colorless liquid; the residue was washed with water and dried in vacuo. $C_6F_{13}C_2H_4SCH_2CH_2NH_2$ was obtained quantitatively as a colorless solid.

In a 500 mL three neck flask (with mechanical stirrer, temperature probe, dropping funnel —$N_2$), containing dry toluene (350 mL), one equivalent of each of the $C_6F_{13}C_2H_4SCH_2CH_2NH_2$ (0.1 mol) and trimethyl amine (0.1 mol) were added. The mixture was cooled to 0° C. Ethyl chloroformate (0.11 mol) was added dropwise within 20 min. The mixture was allowed to warm to room temperature while stirring was continued. A second equivalent of triethyl amine was added followed by the dropwise addition of methyl trichlorosilane (0.12 mol) at 30-40° C. (addition time about 20-30 min). The dropping funnel was replaced with a reflux condenser. The mixture was heated to 100° C. for 1 h (less than the reflux temperature of toluene). After the mixture was cooled to ambient temperature the precipitated ammonium salts were filtered into a flask using a glass frit. Under steady $N_2$ flow, both toluene and generated ethoxy methyl dichlorosilane were distilled off at 200 mm Hg ($266.6\times10^2$ Pa). The collected organic by-product was treated with dilute aqueous bicarbonate solution to quench the silane. The residue was dried at 2 mm Hg ($2.67\times10^2$ Pa) using a dry-ice cooled trap to furnish $C_6F_{13}C_2H_4SCH_2CH_2NCO$ in 95% yield as a light red-brown liquid.

An equivalent of 1H,1H,2H,2H-perfluorooctyl isocyanatoethyl thioether ($C_6F_{13}C_2H_4SCH_2CH_2NCO$), dissolved in toluene, was added dropwise to a solution of one equivalent of aminopropyl triethoxysilane (commercially available from Gelest Inc, Morrisville, Pa.), dissolved in toluene, at 0° C. The mixture was stirred at ambient temperature for one hour. The solvent was removed under vacuum to provide the $C_6F_{13}CH_2CH_2SCH_2CH_2NHC(O)NHCH_2CH_2Si(OCH_2CH_3)_3$ as an amber oil.

The following was an adapted synthetic procedure from *J. Am. Chem. Soc.* 2007, 129, 5052-5060. Reactive particles (150 g, commercially available under the name AEROSIL VT2640 from Evonik Degussa, Essen, Germany) and toluene (1 L) were placed in a 3 L 3-neck flask equipped with a mechanical stirrer and a Dean-Stark reflux condenser. This mixture was stirred at 50° C. for 2 h to achieve a homogeneous dispersion, after which p-toluenesulfonic acid (PTSA, 1.00 g) and $C_6F_{13}CH_2CH_2SCH_2CH_2NHC(O)NHCH_2CH_2Si(OCH_2CH_3)_3$ (30.0 g) was added. The mixture was heated up to reflux temperature (110° C. for toluene) and continued to stir at this temperature for 2 h, after which it was checked that no further modification was produced resulting in the desired fluorinated reactive particle.

After cooling, the fluorinated reactive particle was isolated from the reaction medium by centrifugation and purified by means of repetitive washing in ethanol (3 times) and further centrifugation. Finally, the fluorinated reactive particles were dried at 100° C. for 12 h.

EXAMPLES

Example 1

A reaction flask was charged with of DESMODUR N3300A HDI-based isocyanate (20.6 g) available from Bayer Corporation, Pittsburgh, Pa., methyl isobutyl ketone (MIBK, 12.1 g) and a 0.005 M dibutyltin dilaurate solution (1.5 g) in MIBK. The mixture was heated to 60° C. followed by the steady dropwise addition of 1H,1H,2H,2H-perfluorooctanol (30 g). After addition was complete, the reaction temperature was raised to 85° C. and held for 3 h. A solution containing fluorinated reactive particles (0.05 g) prepared as described above, sonified in 38.3 g MIBK and 0.8 g water was added and the resulting mixture was heated and stirred at 85° C. for an additional 12 h. The mixture was then cooled to 70° C. and a mixture of WITCO C-6094 (8.3 g) available from Witco Corporation, Greenwich, Conn., and deionized water (87.6 g), heated to 70° C., was then added. Sonication of the mixture, followed by the distillation of MIBK under reduced pressure, and gravity filtration through a milk filter, gave the desired emulsion polymer.

The product of Example 1 was applied to carpet which was yellow nylon 6,6 commercial level loop carpet having 28 oz/square yard (0.95 kg/square meter). The composition was diluted with water and applied to the carpet with spray application at 25% wet pick-up with a goal of 800 ppm (microgram per gram) of fluorine on the carpet fiber weight. This was followed by an oven cure to achieve a face fiber temperature of 250° F. (121° C.) for at least one minute. The carpet was tested according to Test Methods 1, 2 and 3 for, water repellency, oil repellency, and soil resistance. Results are in Table 3.

Comparative Example A

This example demonstrated a composition prepared as in Example 1 but with no particulate component added into the reaction. A flask was charged with N3300A HDI-based isocyanate (34.4 g) available from Bayer Corporation, Pittsburgh, Pa., methyl isobutyl ketone (MIBK, 20.2 g) and a 0.005 M dibutyltin dilaurate solution (2.5 g) in MIBK. The mixture was heated to 60° C. followed by the steady dropwise addition of 1H,1H,2H,2H-perfluorooctanol (50 g). After addition was complete, the reaction temperature was raised to 85° C. and held for 3 h. After 3 h, MIBK (63.9 g) and water (1.1 g) were added and the resulting mixture was heated and stirred at 85° C. for an additional 12 h. The mixture was then cooled to 70° C. and a mixture of WITCO C-6094 (13.8 g) available from Witco Corporation, Greenwich, Conn., and deionized water (145.8 g), heated to 70° C., was then added. Sonication of the mixture, followed by the distillation of MIBK under reduced pressure, and gravity filtration through a milk filter gave the desired emulsion polymer.

The product of Comparative Example A was applied to carpet which was yellow nylon 6,6 commercial level loop carpet having 28 oz/square yard (0.95 kg/square meter). The composition was diluted with water and applied to the carpet with spray application at 25% wet pick-up with a goal of 800 ppm (microgram per gram) of fluorine on the carpet fiber weight. This was followed by an oven cure to achieve a face fiber temperature of 250° F. (121° C.) for at least one minute. The carpet was tested according to Test Methods 1, 2 and 3 for water repellency, oil repellency, and soil resistance. Results are in Table 3.

Comparative Example B

This example demonstrated a composition prepared as in Example 1 but wherein the particulate component was not reacted with the polymer, but was simply physically mixed with the polymer after its formation. A flask was charged with N3300A HDI-based isocyanate (20.6 g) available from Bayer Corporation, Pittsburgh, Pa., methyl isobutyl ketone (MIBK, 12.1 g) and a 0.005 M dibutyltin dilaurate solution (1.5 g) in MIBK. The mixture was heated to 60° C. followed by the steady dropwise addition of 1H,1H,2H,2H-perfluorooctanol (30 g). After addition was complete, the reaction temperature was raised to 85° C. and held for 3 h. After 3 h, MIBK (35.0 g) and water (0.8 g) were added and the resulting mixture was heated and stirred at 85° C. for an additional 12 h. The mixture was then cooled to 70° C. followed by the addition of a heated mixture (70° C.) of 8.3 g WITCO C-6094 available from Witco Corporation, Greenwich, Conn., and 87.6 g of deionized water. Sonication of the mixture followed by the distillation of MIBK under reduced pressure and gravity filtration through a milk filter gave the desired emulsion polymer. To the final emulsion was then added fluorinated reactive particles (0.05 g) prepared as described above followed by sonication.

The product of Comparative Example B was applied to carpet which was yellow nylon 6,6 commercial level loop carpet having 28 oz/square yard (0.95 kg/square meter). The composition was diluted with water and applied to the carpet with spray application at 25% wet pick-up with a goal of 800 ppm (microgram per gram) of fluorine on the carpet fiber weight. This was followed by an oven cure to achieve a face fiber temperature of 250° F. (121° C.) for at least one minute. The carpet was tested according to Test Methods 1, 2 and 3 for water repellency, oil repellency, and soil resistance. Results are in Table 3.

TABLE 3

| Example | Microg/g F | Water Repellency | Oil Repellency | Soil Resistance ΔE | ΔΔE |
|---|---|---|---|---|---|
| Example 1 | 800 | 6 | 4 | 16.73 | |
| Comp. Ex A | 800 | 5 | 5 | 18.54 | +1.81 |
| Comp. Ex B | 800 | 5 | 5 | 17.41 | +.068 |
| Untreated Carpet Sample | 0 | 0 | 0 | 26.19 | +9.46 |
| Example 1 | 400 | 5 | 5 | 17.54 | |
| Comparative Example A | 400 | 5 | 5 | 18.95 | +1.41 |

Table 3 shows the results for water repellency, oil repellency and soil resistance for Example 1 (with reacted fluorinated reactive particles), Comparative Examples A (no fluorinated reactive particles) and Comparative Example B (Comparative Example A blended with fluorinated reactive particles), and an untreated carpet sample. At 800 micrograms/gram fluorine loading, Example 1 had improved water repellency and improved soil resistance compared to the untreated carpet sample and Comparative Examples A and B. At 400 micrograms/gram loading, Example 1 showed similar water and oil repellency and a higher soil resistance than Comparative Example A at the same fluorine loading.

Example 2

A perfluoropropylvinyl ether (PPVE, $CF_3(CF_2)_2OCHFCF_2CH_2CH_2OH$) alcohol was prepared for use in Example 2 as follows. In a dry box, a 500 mL Pyrex bottle was charged with diethylene glycol (175 mL, 99%, commercially available from Aldrich Chemical Company, Milwaukee, Wis.) and 80 mL of anhydrous tetrahydrofuran. Sodium hydride (3.90 g) was added slowly with magnetic stirring until the completion of hydrogen evolution. The capped bottle was removed from the drybox, and the solution was transferred to a 400 mL metal shaker tube in a nitrogen filled glovebag. The shaker tube was cooled to an internal temperature of −18° C., shaking was started, and perfluoropropylvinyl ether (41 g) was added from a metal cylinder. The mixture was allowed to warm to room temperature and was shaken for 20 h. The reaction mixture was combined with a duplicate reaction run in a separate 400 mL shaker tube. The combined reaction mixtures were added to 600 mL of water, and this mixture was extracted with 3×200 mL of diethyl ether in a separatory funnel. The ether extracts were dried over MgSO4, filtered, and concentrated in vacuo on a rotary evaporator to give a liquid (119.0 g) 1H NMR in $CD_3OD$, and analysis by gas chromatography both showed a small amount of diethylene glycol. This material was dissolved in 150 mL of diethyl ether and extracted with water (3×150 mL) in a separatory funnel. The ether layer was dried over $MgSO_4$, filtered, and concentrated in vacuo on a rotary evaporator at high vacuum to give $CF_3(CF_2)_2CHFCF_2CH_2CH_2OH$ (99.1 g) $^1H$ NMR ($C_6D_6$, ppm downfield of TMS) shows 97 mole % desired mono-PPVE adduct: 1.77 (broad s, OH), 3.08-3.12 (m, $OCH_2CH_2OCH_2CH_2OH$), 3.42 (t, $OCH_2CH_2OCH_2CH_2OH$), 3.61 (t, $OCH_2CH_2OCH_2CH_2OH$), 5.496 (doublet of triplets, $^2JH-F=53$ Hz, $^3JH-F=3$ Hz $OCF_2CHFOC_3F_7$), and 3 mole % of the bis PPVE adduct: 5.470 (doublet of triplets, $^2JH-F=53$ Hz, $^3JH-F=3$ Hz, $C_3F7OCHFCF_2OCH_2CH_2OCH_2CH_2OCF_2CHFO—C_2F_7$) The other peaks for the bis PPVE adduct overlap with the mono PPVE adduct.

A reaction flask was charged with of DESMODUR N3300A HDI-based isocyanate (20.6 g) available from Bayer Corporation, Pittsburgh, Pa., methyl isobutyl ketone (MIBK, 12.1 g) and a 0.005 M dibutyltin dilaurate solution (1.5 g) in MIBK. The flask was heated to 60° C. followed by the steady dropwise addition of $CF_3(CF_2)_2OCHFCF_2CH_2CH_2OH$ (32.1 g). After addition was complete, the reaction temperature was raised to 85° C. and held for 3 h. A solution containing fluorinated reactive particles (0.05 g) prepared as described above, sonified in 38.3 g MIBK and 0.8 g water was added and the resulting mixture was heated and stirred at 85° C. for an additional 12 h. The mixture was then cooled to 70° C. and a mixture of WITCO C-6094 (8.3 g) available from Witco Corporation, Greenwich, Conn., and deionized water (87.6 g), heated to 70° C., was then added. Sonication of the mixture, followed by the distillation of MIBK under reduced pressure, and gravity filtration through a milk filter, gave the desired emulsion polymer.

The product of Example 2 was applied to carpet which was yellow nylon 6,6 commercial level loop carpet having 28 oz/square yard (0.95 kg/square meter). The composition was diluted with water and applied to the carpet with spray application at 25% wet pick-up with a goal of 800 ppm (microgram per gram) of fluorine on the carpet fiber weight. This was followed by an oven cure to achieve a face fiber temperature of 250° F. (121° C.) for at least one minute. The carpet was tested according to Test Methods 1, 2 and 3 for, water repellency, oil repellency, and soil resistance. Results are in Table 4.

Comparative Example C

This example demonstrated a composition prepared as in Example 3 but with no particulate component added into the reaction. A flask was charged with N3300A HDI-based isocyanate (20.6 g) available from Bayer Corporation, Pittsburgh, Pa., methyl isobutyl ketone (MIBK, 12.1 g) and a 0.005 M dibutyltin dilaurate solution (2.5 g) in MIBK. The mixture was heated to 60° C. followed by the steady dropwise addition of $CF_3(CF_2)_2CHFCF_2CH_2CH_2OH$ (32.1 g). After addition was complete, the reaction temperature was raised to 85° C. and held for 3 h. After 3 h, MIBK (38.3 g) and water (0.79 g) were added and the resulting mixture was heated and stirred at 85° C. for an additional 12 h. The mixture was then cooled to 70° C. and a mixture of WITCO C-6094 (8.3 g) available from Witco Corporation, Greenwich, Conn., and deionized water (87.6 g), heated to 70° C., was then added. Sonication of the mixture, followed by the distillation of MIBK under reduced pressure, and gravity filtration through a milk filter gave the desired emulsion polymer.

The product of Comparative Example C was applied to carpet which was yellow nylon 6,6 commercial level loop carpet having 28 oz/square yard (0.95 kg/square meter). The composition was diluted with water and applied to the carpet with spray application at 25% wet pick-up with a goal of 800 ppm (microgram per gram) of fluorine on the carpet fiber weight. This was followed by an oven cure to achieve a face fiber temperature of 250° F. (121° C.) for at least one minute. The carpet was tested according to Test Methods 1, 2 and 3 for, water repellency, oil repellency, and soil resistance. Results are in Table 4.

Comparative Example D

This example demonstrated a composition prepared as in Example 3 but wherein the particulate component was not reacted with the polymer, but was simply physically mixed with the polymer after its formation. A flask was charged with N3300A HDI-based isocyanate (20.6 g) available from Bayer Corporation, Pittsburgh, Pa., methyl isobutyl ketone (MIBK, 12.1 g) and a 0.005 M dibutyltin dilaurate solution (1.5 g) in MIBK. The mixture was heated to 60° C. followed by the steady dropwise addition of $CF_3(CF_2)_2OCHFCF_2CH_2CH_2OH$ (27.0 g). After addition was complete, the reaction temperature was raised to 85° C. and held for 3 h. After 3 h, MIBK (35.0 g) and water (0.8 g) were added and the resulting mixture was heated and stirred at 85° C. for an additional 12 h. The mixture was then cooled to 70° C. followed by the addition of a heated mixture (70° C.) of 8.3 g WITCO C-6094 available from Witco Corporation, Greenwich, Conn., and 87.6 g of deionized water. Sonication of the mixture followed by the distillation of MIBK under reduced pressure and gravity filtration through a milk filter gave the desired emulsion polymer. To the final emulsion was then added fluorinated reactive particles (0.05 g) prepared as described above followed by sonication.

The product of Comparative Example D was applied to carpet which was yellow nylon 6,6 commercial level loop carpet having 28 oz/square yard (0.95 kg/square meter). The composition was diluted with water and applied to the carpet with spray application at 25% wet pick-up with a goal of 800 ppm (microgram per gram) of fluorine on the carpet fiber weight. This was followed by an oven cure to achieve a face fiber temperature of 250° F. (121° C.) for at least one minute. The carpet was tested according to Test Methods 1, 2 and 3 for, water repellency, oil repellency, and soil resistance. Results are in Table 4.

TABLE 4

| Example | Microg/g F | Water Repellency | Oil Repellency | Soil resistance ΔE | ΔΔE |
|---|---|---|---|---|---|
| Example 2 | 800 | 4 | 4 | 25.83 | |
| Comp. Ex C | 800 | 5 | 4 | 33.82 | +7.99 |
| Comp. Ex D | 800 | 5 | 4 | 30.91 | +5.08 |
| Untreated Carpet Sample | 0 | 0 | 0 | 23.29 | −2.54 |
| Example 2 | 400 | 5 | 4 | 22.32 | |
| Comparative Example C | 400 | 4 | 4 | 31.79 | +9.47 |

Table 4 shows the results for water repellency, oil repellency and soil resistance for Example 2 (with reacted fluorinated reactive particles), Comparative Example C (no particles) and Comparative Example D (Comparative Example C blended with fluorinated reactive particles), and an untreated carpet sample. At 800 micrograms/gram fluorine loading, Example 2 had improved water and oil repellency and improved soil resistance compared to the untreated carpet sample. Example 2 had improved soil resistance compared to Comparative Examples C and D while having similar oil repellency and a slight decrease in water repellency. At 400 micrograms/gram loading, Example 2 showed slightly improved water repellency and similar oil repellency. Example 2 showed improved soil resistance over Comparative Example C at the same fluorine loading.

Example 3

A one gallon reactor was charged with perfluoroethylethyl iodide (PFEEI, 850 g, available from E. I. du Pont de Nemours and Company, Wilmington, Del.). After cool evacuation, ethylene and tetrafluoroethylene in 27:73 ratio were added until pressure reached 60 psig ($413.7\times10^3$ Pa). The reaction was then heated to 70° C. More ethylene and tetrafluoroethylene in 27:73 ratio were added until pressure reached 160 psig ($1103\times10^3$ Pa). A lauroyl peroxide solution (4 g lauroyl peroxide in 150 g perfluoroethylethyl iodide) was added at 1 mL/min rate for 1 hour. Gas feed ratio was adjusted to 1:1 of ethylene and tetrafluoroethylene and the pressure maintained at 160 psig ($1103\times10^3$ Pa). After about 67 g of ethylene was added, both ethylene and tetrafluoroethylene feeds were stopped. The reaction was heated at 70° C. for another 8 hours. The volatiles were removed by vacuum distillation at room temperature. A mixture of iodides (773 g) was obtained, which contained 1,1,2,2,5,5,6,6-octahydroperfluoro-1-iodooctane and 1,1,2,2,5,5,6,6,9,9,10,10-dodecahydroperfluoro-1-iodododecane as major components in about 2:1 ratio.

The mixture of iodides, containing 1,1,2,2,5,5,6,6-octahydroperfluoro-1-iodooctane and 1,1,2,2,5,5,6,6,9,9,10,10-dodecahydroperfluoro-1-iodododecane (46.5 g) and N-methylformamide (NMF) (273 mL) was heated to 150° C. for 19 hours. The reaction mixture was washed with water (4×500 mL) to give a residue. A mixture of this residue, ethanol (200 mL), and concentrated hydrochloric acid (1 mL) was gently refluxed (85° C. bath temperature) for 24 hours. The reaction mixture was poured into water (300 mL). The solid was washed with water (2×75 mL) and dried under vacuum (2 torr) to give a mixture of alcohols, 26.5 g, which contained 1,2,2,5,5,6,6-octahydroperfluoro-1-octanol and 1,1,2,2,5,5,6,6,9,9,10,10-dodecahydroperfluoro-1-dodecanol as major components.

A reaction flask was charged with of DESMODUR N3300A HDI-based isocyanate (20.6 g) available from Bayer Corporation, Pittsburgh, Pa., methyl isobutyl ketone (MIBK, 12.1 g) and a 0.005 M dibutyltin dilaurate solution (1.5 g) in MIBK. The mixture was heated to 60° C. followed by the steady dropwise addition of a mixture of 1,2,2,5,5,6,6-octahydroperfluoro-1-octanol and 1,1,2,2,5,5,6,6,9,9,10,10-dodecahydroperfluoro-1-dodecanol (33.3 g). After addition was complete, the reaction temperature was raised to 85° C. and held for 3 h. A solution containing fluorinated reactive particles (0.05 g) prepared as described above, sonified in 38.3 g MIBK and 0.8 g water was added and the resulting mixture was heated and stirred at 85° C. for an additional 12 h. The mixture was then cooled to 70° C. and a mixture of WITCO C-6094 (8.3 g) available from Witco Corporation, Greenwich, Conn., and deionized water (87.6 g), heated to 70° C., was then added. Sonication of the mixture, followed by the distillation of MIBK under reduced pressure, and gravity filtration through a milk filter, gave the desired emulsion polymer.

The product of Example 3 was applied to carpet which was yellow nylon 6,6 commercial level loop carpet having 28 oz/square yard (0.95 kg/square meter). The composition was diluted with water and applied to the carpet with spray application at 25% wet pick-up with a goal of 800 ppm (microgram per gram) of fluorine on the carpet fiber weight. This was followed by an oven cure to achieve a face fiber temperature of 250° F. (121° C.) for at least one minute. The carpet was tested according to Test Methods 1, 2 and 3 for, water repellency, oil repellency, and soil resistance. Results are in Table 5.

Comparative Example E

This example demonstrated a composition prepared as in Example 3 but with no particulate component added into the reaction. A flask was charged with N3300A HDI-based isocyanate (20.6 g) available from Bayer Corporation, Pittsburgh, Pa., methyl isobutyl ketone (MIBK, 12.1 g) and a 0.005 M dibutyltin dilaurate solution (2.5 g) in MIBK. The mixture was heated to 60° C. followed by the steady dropwise addition of a mixture of 1,2,2,5,5,6,6-octahydroperfluoro-1-octanol and 1,1,2,2,5,5,6,6,9,9,10,10-dodecahydroperfluoro-1-dodecanol (33.3 g). After addition was complete, the reaction temperature was raised to 85° C. and held for 3 h. After 3 h, MIBK (38.3 g) and water (0.79 g) were added and the resulting mixture was heated and stirred at 85° C. for an additional 12 h. The mixture was then cooled to 70° C. and a mixture of WITCO C-6094 (8.3 g) available from Witco Corporation, Greenwich, Conn., and deionized water (87.6 g), heated to 70° C., was then added. Sonication of the mixture, followed by the distillation of MIBK under reduced pressure, and gravity filtration through a milk filter gave the desired emulsion polymer.

The product of Comparative Example E was applied to carpet which was yellow nylon 6,6 commercial level loop carpet having 28 oz/square yard (0.95 kg/square meter). The composition was diluted with water and applied to the carpet with spray application at 25% wet pick-up with a goal of 800 ppm (microgram per gram) of fluorine on the carpet fiber weight. This was followed by an oven cure to achieve a face fiber temperature of 250° F. (121° C.) for at least one minute. The carpet was tested according to Test Methods 1, 2 and 3 for, water repellency, oil repellency, and soil resistance. Results are in Table 5.

Comparative Example F

This example demonstrates a composition prepared as in Example 3 but wherein the particulate component was not reacted with the polymer, but was simply physically mixed with the polymer after its formation. A flask was charged with N3300A HDI-based isocyanate (20.6 g) available from Bayer Corporation, Pittsburgh, Pa., methyl isobutyl ketone (MIBK, 12.1 g) and a 0.005 M dibutyltin dilaurate solution (1.5 g) in MIBK. The mixture was heated to 60° C. followed by the steady dropwise addition of a mixture of 1,2,2,5,5,6,6-octahydroperfluoro-1-octanol and 1,1,2,2,5,5,6,6,9,9,10,10-dodecahydroperfluoro-1-dodecanol (33.3 g). After addition was complete, the reaction temperature was raised to 85° C. and held for 3 h. After 3 h, MIBK (35.0 g) and water (0.8 g) were added and the resulting mixture was heated and stirred at 85° C. for an additional 12 h. The mixture was then cooled to 70° C. followed by the addition of a heated mixture (70° C.) of 8.3 g WITCO C-6094 available from Witco Corporation, Greenwich, Conn., and 87.6 g of deionized water. Sonication of the mixture followed by the distillation of MIBK under reduced pressure and gravity filtration through a milk filter gave the desired emulsion polymer. To the final emulsion was then added fluorinated reactive particles (0.05 g) prepared as described above followed by sonication.

The product of Comparative Example F was applied to carpet which was yellow nylon 6,6 commercial level loop carpet having 28 oz/square yard (0.95 kg/square meter). The composition was diluted with water and applied to the carpet with spray application at 25% wet pick-up with a goal of 800 ppm (microgram per gram) of fluorine on the carpet fiber weight. This was followed by an oven cure to achieve a face fiber temperature of 250° F. (121° C.) for at least one minute. The carpet was tested according to Test Methods 1, 2 and 3 for, water repellency, oil repellency, and soil resistance. Results are in Table 5.

TABLE 5

| Example | Microg/g F | Water Repellency | Oil Repellency | Soil resistance ΔE | ΔΔE |
|---|---|---|---|---|---|
| Example 3 | 800 | 2 | 4 | 17.03 | |
| Comp. Ex E | 800 | 2 | 5 | 18.23 | +1.20 |
| Comp. Ex F | 800 | 1 | 4 | 22.36 | +5.33 |
| Untreated Carpet Sample | 0 | 0 | 0 | 24.50 | +7.47 |
| Example 3 | 400 | 1 | 4 | 16.9 | |
| Comparative Example E | 400 | 2 | 2 | 17.98 | +1.08 |

Table 5 shows the results for water repellency, oil repellency and soil resistance for Example 3 (with reacted fluorinated reactive particles), Comparative Examples E (no particles) and Comparative Example F (Comparative Example E blended with fluorinated reactive particles), and an untreated carpet sample. At 800 micrograms/gram fluorine loading, Example 3 had similar water and oil repellency to Comparative Examples E and F. Example 3 had improved soil resistance over Comparative Examples E and F. At 400 micrograms/gram loading, Example 3 showed improved oil repellency and soil resistance over Comparative Example E at the same fluorine loading.

What is claimed is:

1. A composition comprising an aqueous solution or dispersion of at least one polyurethane having at least one urea linkage prepared by:

(i) reacting (a) at least one diisocyanate, polyisocyanate, or mixture thereof, having isocyanate groups, and (b) at least one fluorinated compound selected from the formula (I):

$$R_f^1\text{-L-X} \qquad \text{(I)}$$

wherein $R_f^1$ is a monovalent, partially or fully fluorinated, linear or branched, alkyl radical having 2 to 100 carbon atoms; optionally interrupted by 1 to 50 oxygen atoms; wherein the ratio of carbon atoms to oxygen atoms is at least 2:1 and no oxygen atoms are bonded to each other;

L is a bond or a linear or branched divalent linking group having 1 to about 20 carbon atoms, said linking group optionally interrupted by 1 to about 4 hetero-radicals selected from the group consisting of —O—, —$NR^1$—, —S—, —SO—, —$SO_2$—, and —$N(R^1)C(O)$— wherein $R^1$ is H or $C_1$ to $C_6$ alkyl, and said linking group optionally substituted with $CH_2Cl$;

X is OH, $N(R^1)H$, or SH wherein $R^1$ is H or $C_1$-C6 alkyl; and thereafter (ii) reacting with (c) water and (d) 0.05 to about 2.0% by weight of an isocyanate-reactive fluorinated particulate component, based on a total dry weight of the composition;

wherein the isocyanate-reactive fluorinated particulate component comprises inorganic oxides of Si, Ti, Zn, Mn, Al, and Zr having at least one particle having a surface covalently bonded to at least one group represented by formula (IV)

$$(L^2)_d(L^3)_c\text{Si—}(CH_2)_n\text{—}(Z^1)_a\text{—}[C(X^1)]_x\text{—}(Z^2)_l\text{-}Q^1\text{-}R_f \qquad \text{(IV)}$$

wherein:

$L^2$ represents an oxygen covalently bonded to M; and each $L^3$ is independently selected from the group consisting of H, a $C_1$-$C_2$ alkyl, and OH;

d and c are each integers such that: d is greater than or equal to 1, c is greater than or equal to 0, and d+c is 3;

n is independently an integer from 1 to 12;

a, x, and l are each integers such that the moiety of Formula (IV) represented by —$(Z^1)_a$—$[C(X^1)]_x$—$(Z^2)_l$— is at least one of the following moieties:

i) a first moiety wherein a=1, x=1, and l=1;

ii) a second moiety wherein a=1, x=0; and l=0; and iii) a third moiety wherein a=1, x=0, and l=1;

$R_f$ is a $C_2$-$C_{12}$ perfluoroalkyl optionally interrupted by oxygen or methylene, $Q^1$ is selected from the group consisting of a $C_2$-$C_{12}$ hydrocarbylene optionally interrupted by at least one divalent organic group;

$X^1$ is O or S;

wherein in said first moiety $Z^1$ and $Z^2$ are chosen such that:

a) $Z^1$ is —NH— and $Z^2$ is selected from the group consisting of —NH—, —O—, —S—, —NH—$S(O)_2$—, —N[C(O)H]—, —$[HC(COOH)(R^{14})]CH$—S—, and —$(R^{14})CH[HC(COOH)]$—S—;

wherein each $R^{14}$ is independently hydrogen, phenyl, or a monovalent $C_1$-$C_8$ alkyl optionally terminated by —$C_6H_5$, or b) $Z^2$ is —NH— and $Z^1$ is selected from the group consisting of —O—, —S—, —$N[-Q^2-(R_f)]$—, or

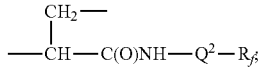

wherein $Q^2$ is independently selected from the group consisting of a $C_2$-$C_{12}$ hydrocarbylene optionally interrupted by at least one divalent organic group;

c) provided that when $Z^1$ or $Z^2$ is O, $Q^1$ is interrupted by at least one divalent moiety selected from the group consisting of —S—, —S(O)—, —S(O)$_2$—, —NH—S(O)$_2$—, —N(CH)$_3$S(O)$_2$—, and

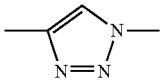

;

and wherein in said second moiety a) $Z^1$ is —N(-$Q^3$-$R_f$)—; and b) $Q^1$ and $Q^3$ are independently chosen from the group consisting of a $C_2$-$C_{12}$ hydrocarbylene interrupted by at least one of —C(O)—O— or —O—CO(O)—, and optionally further interrupted by at least one divalent organic group; and wherein in said third moiety a) $Z^1$ and $Z^2$ are mutually exclusive and are selected from the group consisting of —N($Q^4$)- and —S(O)$_2$—; and b) $Q^4$ is a monovalent moiety selected from the group consisting of $C_2$-$C_{12}$ alkyl, —$C_6H_6$, and —$(CH_2)_g$—NH—S(O)$_2$—$(CH_2)_g$—$R_f$ where g is 1 or 2, and $R_f$ is as defined above.

2. The composition of claim 1 wherein $R_f^1$ is $F(CF_2)_n$, $F(CF_2)_n(CH_2)_x[(CF_2CF_2)_p(CH_2CH_2)_q]_m$, $F(CF_2)_nOF(CF_2)_n$, $F(CF_2)_nOCFHCF_2$, or $F(CF_2)_n[OCF_2CF(CF_3)]_p[OCF_2CF_2]_q$, wherein n is 1 to about 6; x is 1 to about 6; and p, q, and m are each independently 1 to about 3.

3. The composition of claim 1 wherein L is a bond, $R^5$, $R^5$-A, or ethylene oxide, wherein A is a divalent $C_1$-$C_6$ alkyl and $R^5$ is a divalent radical selected from the group consisting of —S($CH_2$)$_u$—,

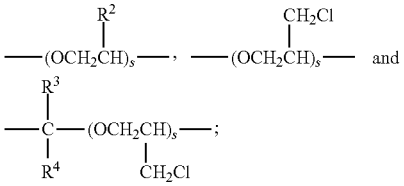

u is an integer of from about 2 to about 4;

s is an integer of 1 to about 4; and $R^2$, $R^3$, and $R^4$ are each independently hydrogen or an alkyl group containing 1 to about 6 carbon atoms.

4. The composition of claim 1 wherein formula (I) is selected from the group consisting of $F(CF_2)_n(CH_2)_t(R^5)_rOH$, $F(CF_2)_n(CH_2)_x[CF_2CF_2)_p(CH_2CH_2)_q]_m(R^5)_rOH$, $F(CF_2)_nO(CF_2)_nCH_2(C_tH_{2t})(R^5)_rOH$, and $F(CF_2)_nOCFHCF_2(OCH_2CH_2)_vOH$, wherein n is an integer of 1 to about 6;

t is an integer of 1 to about 10;

p, q, and m are each independently an integer of 1 to about 3;

r is 0 or 1;

v is an integer of 1 to about 4;

$R^5$ is a divalent radical selected from the group consisting of —S($CH_2$)$_u$—,

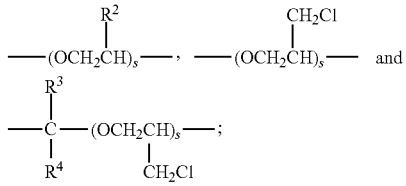

u is an integer of 2 to about 4;

s is an integer of 1 to about 4; and $R^2$, $R^3$, and $R^4$ are each independently hydrogen or an alkyl group containing 1 to about 6 carbon atoms.

5. The composition of claim 4 wherein n is 4 to 6; p, q, and m are each 1; and r is 0.

6. The polymer of claim 1 wherein said fluorinated compound reacts with about 5 mol % to about 90 mol % of said isocyanate groups.

7. The composition of claim 1 wherein the diisocyanate or polyisocyanate is selected from the group consisting of hexamethylene diisocyanate homopolymer, 3-isocyanatomethyl-3,4,4-trimethylcyclohexyl isocyanate, bis-(4-isocyanatocylohexyl)methane and diisocyanate trimers of formulas (IIa), (IIb), (IIc) and (IId):

(IIa)

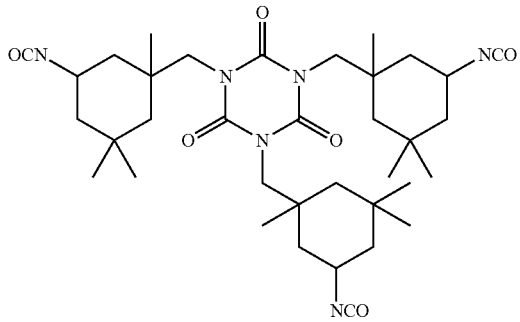

(IIb)

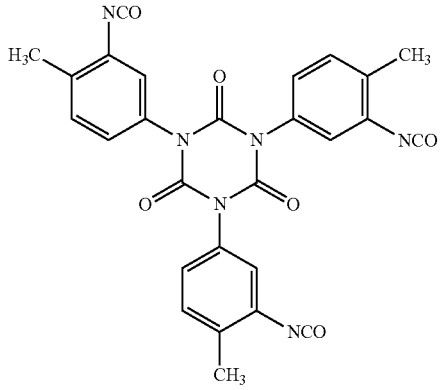

(IIc)

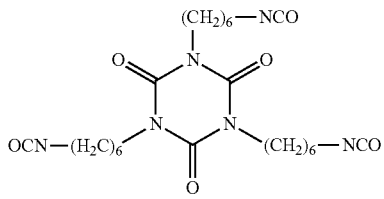

-continued (IId)

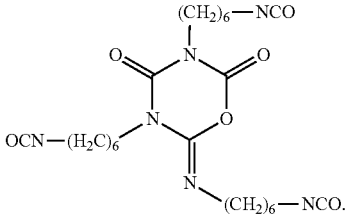

8. The composition of claim 1 wherein step (i) reacting, further comprises (e) a non-fluorinated organic compound selected from the group consisting of formula $$R^{10}—(R^{11})_k—X$$

wherein $R^{10}$ is a $C_1$-$C_{18}$ alkyl, a $C_1$-$C_{18}$ omega-alkenyl radical or a $C_1$-$C_{18}$ omega-alkenoyl;

$R^{11}$ is selected from the group consisting of

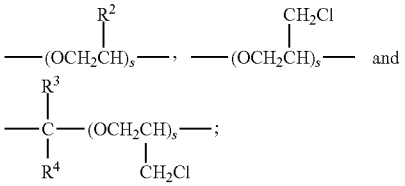

wherein $R^2$, $R^3$ and $R^4$ are each independently, H or $C_1$ to $C_6$ alkyl, and s is an integer of 1 to about 50;

k is 0 or 1,

X is an isocyanate-reactive group selected from the group consisting of —OH, —N(R)H, and —SH, and R is H or $C_1$-$C_6$ alkyl.

9. The composition of claim 8, wherein the compound of formula $R^{10}—(R^{11})_k—X$ comprises a hydrophilic water-solvatable material comprising at least one hydroxy-terminated polyether of formula (III):

Formula (III)

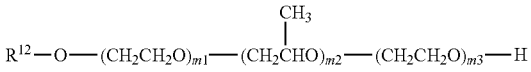

wherein $R^{12}$ is a monovalent $C_1$-$C_6$ alkyl or cycloalkyl radical;

m1 is a positive integer, and m2 and m3 are each independently a positive integer or zero; said polyether having a weight average molecular weight up to about 2000.

10. The composition of claim 8 wherein said non-fluorinated compound reacts with about 0.1 mol % to about 60 mol % of said isocyanate groups.

11. The composition of claim 1 the inorganic oxides are at least partially surface-modified with hydrophobic groups, said hydrophobic groups derived from reaction of inorganic oxides with hydrophobic surface treatment reagents selected from the group consisting of alkyl halosilanes including $C_1$-$C_{18}$ alkyl trichlorosilanes, $C_1$-$C_{18}$ dialkyl dichlorosilanes, $C_1$-$C_{18}$ trialkyl chlorosilanes; alkyl alkoxysilanes including $C_1$-$C_{18}$ alkyl trimethoxysilanes, $C_1$-$C_{18}$ dialkyl dimethoxysilanes, $C_1$-$C_{18}$ trialkyl methoxysilanes, and $C_1$-$C_{18}$ alkyl triethoxysilanes; perfluoroalkyl chlorosilanes including $C_1$-$C_{18}$ perfluoroalkylethyl trichlorosilanes, perfluoroalkyl alkoxysilanes including $C_1$-$C_{18}$ perfluoroalkylethyl trimethoxysilanes, and $C_1$-$C_{18}$ perfluoroalkylethyl trimethoxysilanes; alkyl disilazanes including hexamethyl disilazane; polydialkyl siloxanes including polydimethyl siloxane; aminoalkyl alkoxysilanes including 3-aminopropyl trimethoxysilane and 3-aminopropyl triethoxysilane; and mixtures thereof.

12. The composition of claim 1 wherein M is Si.

13. The composition of claim 1 wherein formula (IV) comprises a urea or thiourea wherein:

a is 1, x is 1, and l is 1;

$Z^1$ and $Z^2$ are both —NH—; and $X^1$ is O or S.

14. The composition of claim 1 wherein (ii) reacting with (c) water and (d) 0.05 to about 2.0% by weight of an isocyanate-reactive particulate component, further comprises (f) a linking agent that is a diamine or polyamine.

15. The composition of claim 1 further comprising one or more agents providing at least one surface effect selected from the group consisting of no iron, easy to iron, shrinkage control, wrinkle free, permanent press, moisture control, softness, strength, anti-slip, anti-static, anti-snag, anti-pill, stain repellency, stain release, soil repellency, soil release, water repellency, oil repellency, stain resist, odor control, antimicrobial, and sun protection.

16. The composition of claim 1 further comprising a surfactant, pH adjuster, cross linker, wetting agent, blocked isocyanate, wax extender, or hydrocarbon extender.

17. A method of providing water repellency, oil repellency and soil resistance to a substrate comprising contacting said substrate with a composition of an aqueous solution or dispersion of at least one polyurethane having at least one urea linkage prepared by:

(i) reacting (a) at least one diisocyanate, polyisocyanate, or mixture thereof, having isocyanate groups, and (b) at least one fluorinated compound selected from the formula (I):

$$R_f^1\text{-L-X} \qquad \text{(I)}$$

wherein $R_f^1$ is a monovalent, partially or fully fluorinated, linear or branched, alkyl radical having 2 to 100 carbon atoms; optionally interrupted by 1 to 50 oxygen atoms; wherein the ratio of carbon atoms to oxygen atoms is at least 2:1 and no oxygen atoms are bonded to each other;

L is a bond or a linear or branched divalent linking group having 1 to about 20 carbon atoms, said linking group optionally interrupted by 1 to about 4 hetero-radicals selected from the group consisting of —O—, —$NR^1$—, —S—, —SO—, —$SO_2$—, and —$N(R^1)C(O)$— wherein $R^1$ is H or $C_1$ to $C_6$ alkyl, and said linking group optionally substituted with $CH_2Cl$;

X is an isocyanate-reactive group selected from the group consisting of —OH, —N(R)H, and —SH; and thereafter (iii) reacting with (c) water and (d) 0.05 to about 2.0% by weight of an isocyanate-reactive fluorinated particulate component, based on a total dry-weight of the composition;

wherein the isocyanate-reactive fluorinated particulate component comprises inorganic oxides of Si, Ti, Zn, Mn, Al, and Zr having at least one particle having a surface covalently bonded to at least one group represented by formula (IV)

$$(L^2)_d(L^3)_e\text{Si}—(CH_2)_n—(Z^1)_a—[C(X^1)]_x—(Z^2)_f\text{Q}^1\text{-R}_f \qquad \text{(IV)}$$

wherein:

$L^2$ represents an oxygen covalently bonded to M; and each $L^3$ is independently selected from the group consisting of H, a $C_1$-$C_2$ alkyl, and OH;

d and c are each integers such that d is greater than or equal to 1, c is greater than or equal to 0, and d+c is 3;

n is independently an integer from 1 to 12;

a, x, and l are each integers such that the moiety of Formula (IV) represented by $—(Z^1)_a—[C(X^1)]_x—(Z^2)_l—$ is at least one of the following moieties:

i) a first moiety wherein a=1, x=1, and l=1;

ii) a second moiety wherein a=1, x=0; and l=0; and iii) a third moiety wherein a=1, x=0, and l=1;

$R_f$ is a $C_2$-$C_{12}$ perfluoroalkyl optionally interrupted by oxygen or methylene, $Q^1$ is selected from the group consisting of a $C_2$-$C_{12}$ hydrocarbylene optionally interrupted by at least one divalent organic group;

$X^1$ is O or S;

wherein in said first moiety $Z^1$ and $Z^2$ are chosen such that:

a) $Z^1$ is —NH— and $Z^2$ is selected from the group consisting of —NH—, —O—, —S—, $—NH—S(O)_2—$, —N[C(O)H]—, —[HC(COOH)($R^{14}$)]CH—S—, and —($R^{14}$)CH[HC(COOH)]—S—;

wherein each $R^{14}$ is independently hydrogen, phenyl, or a monovalent $C_1$-$C_8$ alkyl optionally terminated by $—C_6H_5$, or b) $Z^2$ is —NH— and $Z^1$ is selected from the group consisting of —O—, —S—, —N[-$Q^2$-($R_f$)]—, or

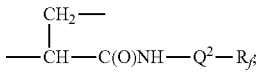

wherein $Q^2$ is independently selected from the group consisting of a $C_2$-$C_{12}$ hydrocarbylene optionally interrupted by at least one divalent organic group;

c) provided that when $Z^1$ or $Z^2$ is O, $Q^1$ is interrupted by at least one divalent moiety selected from the group consisting of —S—, —S(O)—, $—S(O)_2—$, $—NH—S(O)_2—$, $—N(CH)_3S(O)_2—$, and

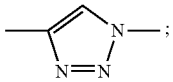

and wherein in said second moiety a) $Z^1$ is —N(-$Q^3$-$R_f$)—; and b) $Q^1$ and $Q^3$ are independently chosen from the group consisting of a $C_2$-$C_{12}$ hydrocarbylene interrupted by at least one of —C(O)—O— or —O—C(O)—, and optionally further interrupted by at least one divalent organic group; and wherein in said third moiety a) $Z^1$ and $Z^2$ are mutually exclusive and are selected from the group consisting of —N($Q^4$)- and $—S(O)_2—$; and b) $Q^4$ is a monovalent moiety selected from the group consisting of $C_2$-$C_{12}$ alkyl, $—C_6H_5$, and $—(CH_2)_g—NH—S(O)_2—(CH_2)_g—R_f$ where g is 1 or 2, and $R_f$ is as defined above.

18. The method of claim 17 wherein the contacting is by exhaustion, foam, flex-nip, nip, pad, kiss-roll, beck, skein, winch, liquid injection, overflow flood, roll, brush, roller, spray, dipping or immersion.

19. A substrate treated according to the method of claim 16.

20. The substrate of claim 19 which is a fiber, yarn, fabric, fabric blend, textile, spunlaced nonwoven, carpet, paper or leather of cotton, cellulose, wool, silk, rayon, nylon, aramid, acetate, acrylic, jute, sisal, sea grass, coir, polyamide, polyester, polyolefin, polyacrylonitrile, polypropylene, polyaramid, or blends thereof.

* * * * *